US011270811B2

(12) United States Patent
Tanaka et al.

(10) Patent No.: US 11,270,811 B2
(45) **Date of Patent: *Mar. 8, 2022**

(54) CONNECTING OBJECT, CONNECTOR AND HARNESS

(71) Applicant: Japan Aviation Electronics Industry, Limited, Tokyo (JP)

(72) Inventors: Yukitaka Tanaka, Tokyo (JP); Yuki Suda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/061,689

(22) Filed: Oct. 2, 2020

(65) Prior Publication Data

US 2021/0166834 A1 Jun. 3, 2021

(30) Foreign Application Priority Data

Dec. 3, 2019 (JP) ..... JP2019-218480

(51) Int. Cl.
*H01B 7/00* (2006.01)
*H01R 13/6582* (2011.01)
(Continued)

(52) U.S. Cl.
CPC ..... *H01B 7/0045* (2013.01); *H01B 7/0869* (2013.01); *H01R 12/594* (2013.01);
(Continued)

(58) Field of Classification Search
CPC .. H01B 7/0869; H01B 7/0861; H01B 7/0838; H01R 13/6582; H01R 12/594; H01R 12/775; H01R 12/79; H01R 12/59
See application file for complete search history.

(56) References Cited

U.S. PATENT DOCUMENTS 5,679,008 A 10/1997 Takahashi et al.
6,489,563 B1 * 12/2002 Zhao ..... H01R 9/0524 174/88 C
(Continued)

FOREIGN PATENT DOCUMENTS

CN 101888034 A 11/2010
CN 202076032 U 12/2011
(Continued)

OTHER PUBLICATIONS

Taiwan Office Action in TW 11020669070, dated Jul. 13, 2021.
(Continued)

*Primary Examiner* — Jean F Duverne
(74) *Attorney, Agent, or Firm* — Collard & Roe, P.C.

(57) ABSTRACT

A connecting object is used for connection to a device. The connecting object has a sheet-like shape. The device has at least two ground pins and at least one signal pin. The at least one signal pin is arranged between two of the ground pins in a pitch direction. The connecting object has a wiring layer, a shield layer and an insulator. The wiring layer is formed with only a signal line which is configured to be connected with the signal pin. The wiring layer is formed with no ground line which is configured to be connected with the ground pin. The shield layer covers the wiring layer via the insulator which is positioned between the shield layer and the wiring layer.

10 Claims, 16 Drawing Sheets

(51) Int. Cl.

| | |
|---|---|
| ***H01B 7/08*** | (2006.01) |
| ***H01R 12/79*** | (2011.01) |
| ***H01R 12/77*** | (2011.01) |
| ***H01R 12/59*** | (2011.01) |

(52) U.S. Cl.
CPC ..... *H01R 12/775* (2013.01); *H01R 12/79* (2013.01); *H01R 13/6582* (2013.01); *H01R 12/59* (2013.01)

(56) References Cited

U.S. PATENT DOCUMENTS

| | | | | |
|---|---|---|---|---|
| 7,399,929 | B2 | 7/2008 | Ueno et al. | |
| 8,221,147 | B2 | 7/2012 | Ozeki | |
| 9,356,403 | B1 * | 5/2016 | Hsu | G11B 33/122 |
| 9,893,448 | B2 | 2/2018 | Mashima et al. | |
| 2009/0101408 | A1 * | 4/2009 | Koyama | H01R 9/0506 174/72 A |
| 2010/0055973 | A1 * | 3/2010 | Yang | H01R 13/717 439/490 |
| 2011/0223777 | A1 | 9/2011 | Ikari et al. | |
| 2015/0207274 | A1 * | 7/2015 | Wu | H01R 13/6597 439/867 |
| 2017/0373414 | A1 | 12/2017 | Sunada | |
| 2018/0076551 | A1 * | 3/2018 | Matsuyama | H01R 12/775 |
| 2019/0190208 | A1 | 6/2019 | Muro | |
| 2021/0167535 | A1 * | 6/2021 | Tanaka | H01R 12/775 |

FOREIGN PATENT DOCUMENTS

| | | | |
|---|---|---|---|
| CN | 104852191 | B | 5/2017 |
| CN | 107799930 | B | 9/2019 |
| JP | 2010-010107 | A | 1/2010 |
| JP | 4526115 | B2 | 8/2010 |
| JP | 5826500 | B2 | 12/2015 |
| JP | 2017-188307 | A | 10/2017 |
| TW | I621309 | B | 4/2018 |
| TW | 201946071 | A1 | 12/2019 |

OTHER PUBLICATIONS

U.S. Office Action in U.S. Appl. No. 17/063,769 dated Sep. 2, 2021.
Taiwan Office Action in TW 109135665, dated Jul. 6, 2021, with English translation.

* cited by examiner

CONNECTING OBJECT, CONNECTOR AND HARNESS

CROSS REFERENCE TO RELATED APPLICATIONS

This application is based on and claims priority under 35 U.S.C. § 119 to Japanese Patent Application No. JP2019-218480 filed Dec. 3, 2019, the contents of which are incorporated herein in their entirety by reference.

BACKGROUND OF THE INVENTION

This invention relates to a connecting object with a sheet-like shape, a connector attachable with the connecting object and a harness comprising the connecting object and the connector.

It is known that, if a wiring layer of a connecting object such as an FFC (Flexible Flat Cable) is provided with a coplanar transmission line which has two ground lines and one signal line or two signal lines which is/are arranged between the ground lines, the connecting object has a common problem that the coplanar transmission line resonates due to multiple reflection. The resonance might degrade transmission quality. Accordingly, the resonance must be prevented from occurring within a frequency band of transmitted signals. One way of preventing the resonance from occurring is to connect ground lines with each other to be commonly grounded so that a resonant frequency is shifted to a frequency which is higher than a frequency band of transmitted signals. It is known that specific means of connecting ground lines with each other is to connect a ground plane or shield layer with ground lines so that the ground lines are connected with each other via the ground plane or shield layer. An FFC, whose ground lines are connected with each other, is disclosed in, for example, JPB4526115 (Patent Document 1).

As shown in FIG. 31, an FFC 900 of Patent Document 1 has conductors 910, or ground lines 910, two conductors 920, or signal lines 920, a shield member 930, or a shield layer 930, a conductive adhesive layer 940 and an insulating member 950, or an insulator 950. The two signal lines 920 are arranged between the ground lines 910. The ground line 910 and the shield layer 930 are connected with each other by the conductive adhesive layer 940. Thus, the ground lines 910 are connected with each other via the conductive adhesive layer 940 and the shield layer 930.

The FFC 900 of Patent Document 1 has a drawback as follows. A process of manufacturing the FFC 900 is complicated so that a cost of manufacturing the FFC 900 is increased.

SUMMARY OF THE INVENTION

It is therefore an object of the present invention to provide a connecting object which can prevent resonance caused by multiple reflection and which can be manufactured in a simplified process. In addition, it is also an object of the present invention to provide a connector, which is attachable with the connecting object, and a harness comprising the connecting object and the connector.

The present invention solves the aforementioned problem in a way different from that of the FFC 900 of Patent Document 1. Specifically, a transmission line of a connecting object of the present invention is configured as a microstrip transmission line or strip transmission line by omitting ground lines. In addition, a connector of the present invention comprises a ground member. Thus, the connector of the present invention is configured so that a shield layer of the connecting object is connected with a mating ground terminal of a mating connector via the ground member when the connector attached with the connecting object is mated with the mating connector.

One aspect (first aspect) of the present invention provides a connecting object used for connection to a device. The connecting object has a sheet-like shape. The device has at least two ground pins and at least one signal pin. The at least one signal pin is arranged between two of the ground pins in a pitch direction. The connecting object has a wiring layer, a shield layer and an insulator. The wiring layer is formed with only a signal line which is configured to be connected with the signal pin. The wiring layer is formed with no ground line which is configured to be connected with the ground pin. The shield layer covers the wiring layer via the insulator which is positioned between the shield layer and the wiring layer.

Another aspect (second aspect) of the present invention provides a connector attachable with a connecting object having a sheet-like shape. The connecting object has a wiring layer, a shield layer and an insulator. The wiring layer includes at least one signal line. The signal line has a signal contact portion. The shield layer covers the wiring layer via the insulator which is positioned between the shield layer and the wiring layer. The connector is mateable with a mating connector along a first direction. The connector comprises a holding member and a ground member. The holding member partially holds the connecting object under an attached state which the connector is attached with the connecting object. The ground member is attached with the holding member. The ground member has a contact spring and at least two ground contact portions. The contact spring is brought into contact with the shield layer under the attached state. Under the attached state, the signal contact portion of the at least one signal line is positioned between two of the ground contact portions in a second direction perpendicular to the first direction. The mating connector comprises at least one mating signal terminal and at least two mating ground terminals. When the connector in the attached state is mated with the mating connector, the signal contact portion is brought into contact with the mating signal terminal. When the connector is mated with the mating connector, the ground contact portions are brought into contact with the mating ground terminals, respectively.

Still another aspect (third aspect) of the present invention provides a connector attachable with a connecting object having a sheet-like shape. The connecting object has a wiring layer, a conductive layer and an insulator. The wiring layer includes at least one trace. The trace has a first contact portion. The conductive layer covers the wiring layer via the insulator which is positioned between the conductive layer and the wiring layer. The connector is mateable with a mating connector along a first direction. The connector comprises a holding member and a conductive member. The holding member partially holds the connecting object under an attached state where the connector is attached with the connecting object. The conductive member is attached with the holding member. The conductive member has a contact spring and at least two second contact portions. The contact spring is brought into contact with the conductive layer under the attached state. Under the attached state, the first contact portion of the at least one trace is positioned between two of the second contact portions in a second direction perpendicular to the first direction. The mating connector comprises at least one mating first terminal and at least two mating second terminals. When the connector in the attached state is mated with the mating connector, the first contact portion is brought into contact with the mating first terminal. When the connector is mated with the mating connector, the second contact portions are brought into contact with the mating second terminals, respectively.

Yet another aspect (fourth aspect) of the present invention provides a harness comprising a connecting object and a connector. The connecting object has a sheet-like shape. The connecting object has a wiring layer, a shield layer and a first insulator. The wiring layer includes at least one signal line. The signal line has a signal contact portion. The shield layer covers the wiring layer via the first insulator which is positioned between the shield layer and the wiring layer. The connector is attached with the connecting object. The connector is mateable with a mating connector along a first direction. The connector comprises a holding member and a ground member. The holding member partially holds the connecting object. The ground member is attached with the holding member. The ground member has a contact spring and at least two ground contact portions. The contact spring is brought into contact with the shield layer. The signal contact portion of the at least one signal line is positioned between two of the ground contact portions in a second direction perpendicular to the first direction. The mating connector comprises at least one mating signal terminal and at least two mating ground terminals. The signal contact portion is brought into contact with the mating signal terminal under a mated state where the connector is mated with the mating connector. The ground contact portions are brought into contact with the mating ground terminals, respectively, under the mated state.

The connecting object has the wiring layer and the shield layer which covers the wiring layer via the first insulator positioned between the shield layer and the wiring layer. The wiring layer is formed with only the signal line, which is configured to be connected with the signal pin of the device, and is formed with no ground line which is configured to be connected with the ground pin of the device. Thus, a transmission line of the connecting object of the present invention is configured as a microstrip transmission line or strip transmission line. Specifically, the connecting object of the present invention can prevent resonance caused by multiple reflection and can be manufactured in a simplified process.

The connector of the present invention comprises the ground member which has the contact spring and the at least two ground contact portions. Under the attached state where the connector is attached with the connecting object, the contact spring is brought into contact with the shield layer of the connecting object. Additionally, when the connector is mated with the mating connector, the ground contact portions are brought into contact with the mating ground terminals, respectively, of the mating connector. This enables the connector of the present invention to be configured so that, when the connector is mated with the mating connector while being in the attached state where the connector is attached with the connecting object, the mating ground terminal is connected, via the ground member, with the shield layer of the connecting object whose transmission line is configured as a microstrip transmission line or strip transmission line. Thus, the connector of the present invention can prevent resonance caused by multiple reflection.

The harness of the present invention comprises the connector with the ground member. The ground member has the contact spring and the at least two ground contact portions. The contact spring is brought into contact with the shield layer of the connecting object. The ground contact portions are brought into contact with the mating ground terminals, respectively, of the mating connector under the mated state where the connector is mated with the mating connector. This enables the harness of the present invention to be configured so that, when the connector attached with the connecting object is mated with the mating connector, the mating ground terminal is connected, via the ground member, with the shield layer of the connecting object whose transmission line is configured as a microstrip transmission line or strip transmission line. Thus, the harness of the present invention can prevent resonance caused by multiple reflection.

An appreciation of the objectives of the present invention and a more complete understanding of its structure may be had by studying the following description of the preferred embodiment and by referring to the accompanying drawings.

Figure 1:
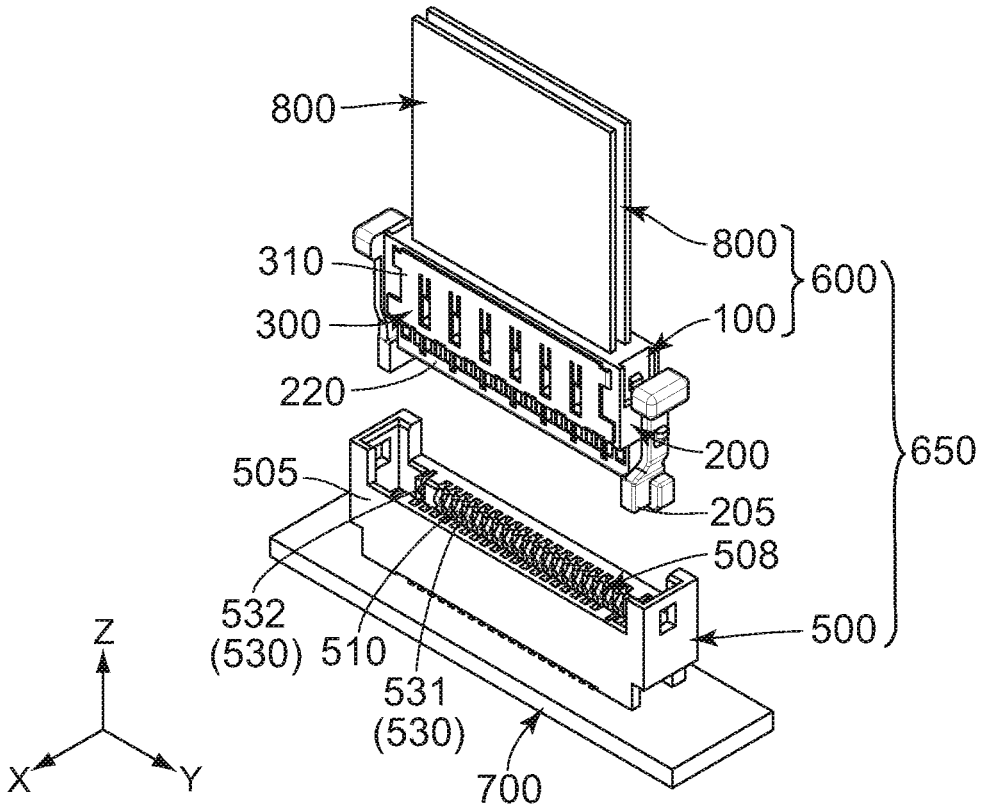
FIG. 1 is a perspective view showing a connector assembly according to an embodiment of the present invention. In the figure, a connector of a harness is in an unmated state where the connector is unmated with a mating connector, the mating connector is fixed on a circuit board, and upper parts of a wiring layer and a shield layer of a connecting object are omitted.
Figure 2:
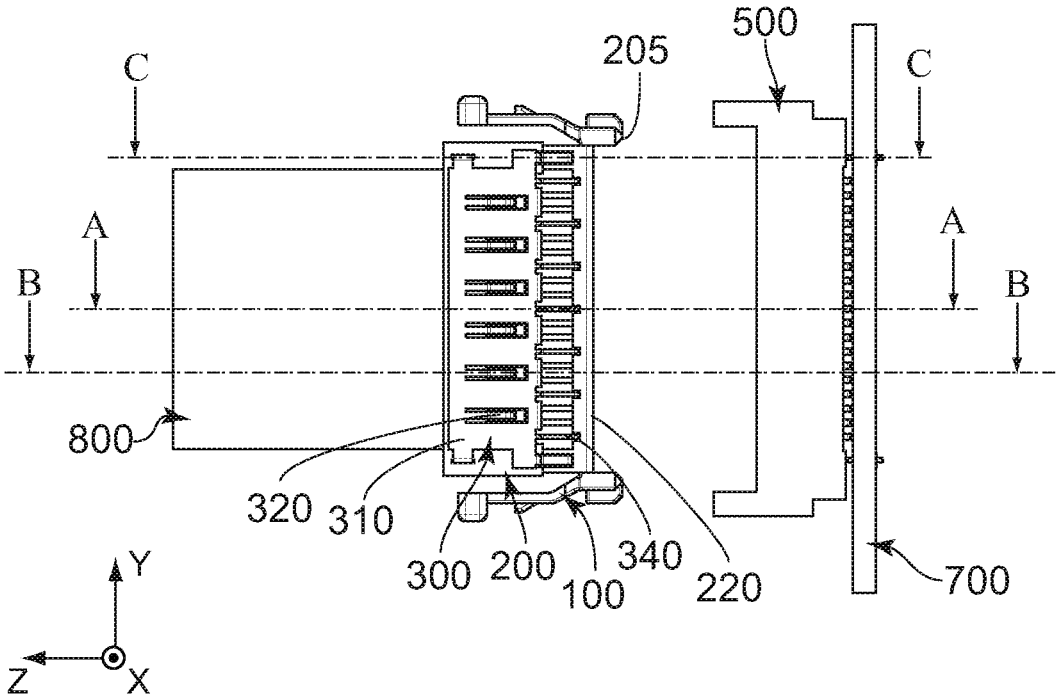
FIG. 2 is a front view showing the connector assembly of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector assembly 650 according to an embodiment of the present invention comprises a mating connector 500 and a harness 600.

As shown in FIG. 1, the mating connector 500 of the present embodiment is fixed on a circuit board 700 when used. The mating connector 500 of the present embodiment is a straight connector. The mating connector 500 comprises a mating holding member 505, a plurality of mating signal terminals 510 and a plurality of mating ground terminals 530. However, the present invention is not limited thereto. The mating connector 500 should comprises at least one mating signal terminal 510 and at least two mating ground terminals 530. In the present application, the mating signal terminal 510 is also referred to as a mating first terminal, and the mating ground terminal 530 is also referred to as a mating second terminal.

Figure 11:
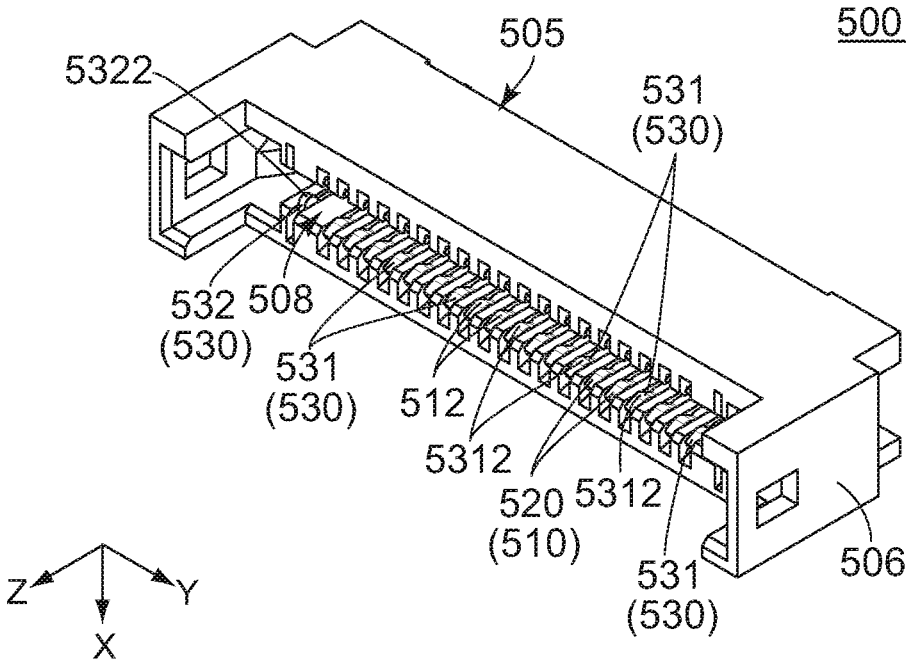
FIG. 11 is a perspective view showing the mating connector which is included in the connector assembly of FIG. 1.
Figure 12:
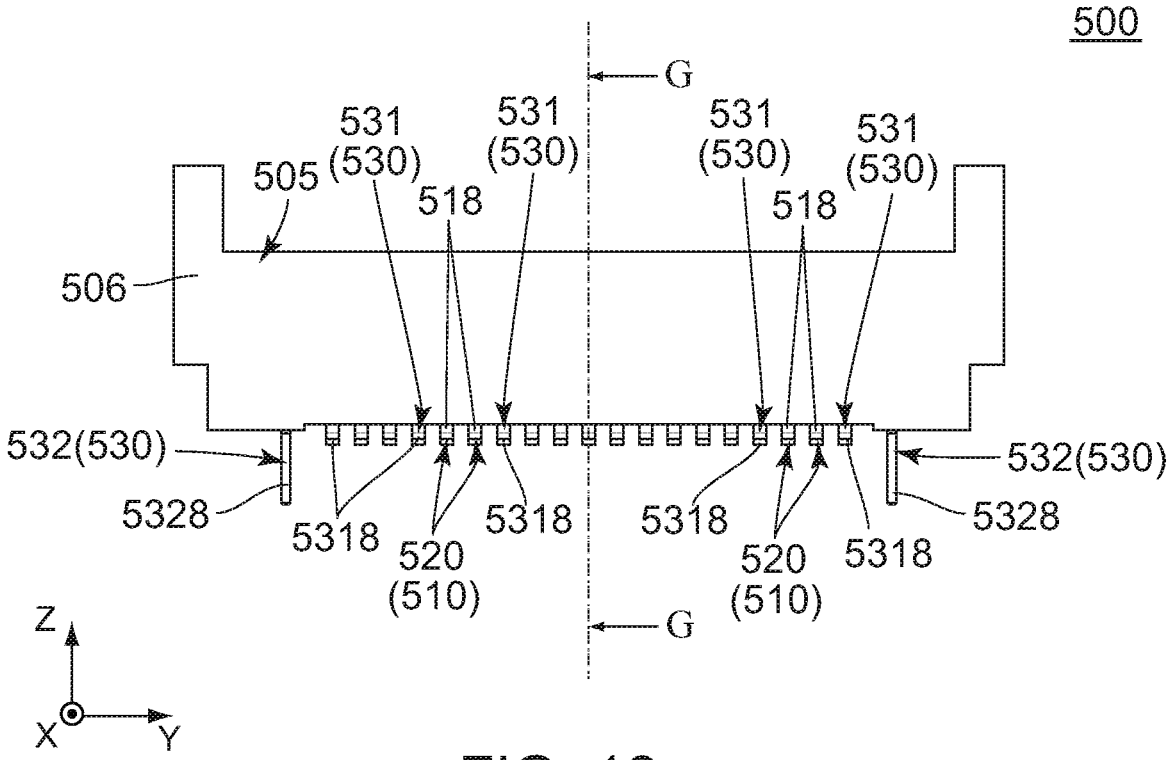
FIG. 12 is a front view showing the mating connector of FIG. 11.
Figure 13:
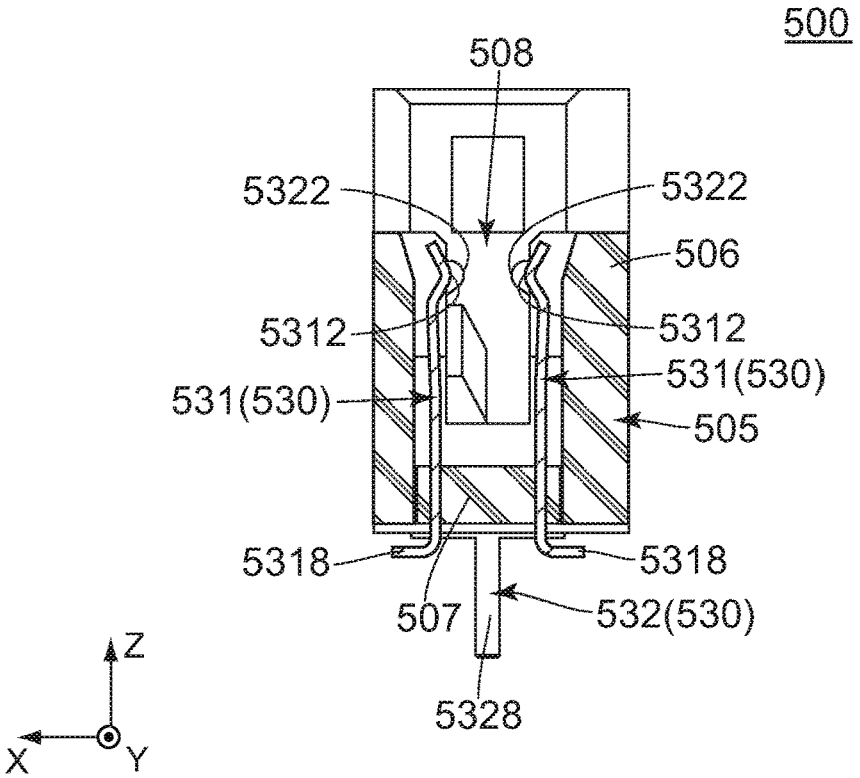
FIG. 13 is a cross-sectional view showing the mating connector of FIG. 12, taken along line G-G.

Referring to FIGS. 11 and 13, the mating holding member 505 of the present embodiment is made of insulator. The mating holding member 505 has a surrounding portion 506, a bottom portion 507 and a mating portion accommodating portion 508.

As shown in FIG. 11, the surrounding portion 506 of the present embodiment has a rectangular tube shape extending in a first direction. An upper end of the surrounding portion 506 is an upper end of the mating connector 500. In the present embodiment, the first direction is a Z-direction. In the present embodiment, the first direction is also referred to as an up-down direction. Specifically, upward is a positive Z-direction while downward is a negative Z-direction. The circuit board 700 of the present embodiment is perpendicular to the first direction. In other words, the circuit board 700 is perpendicular to the up-down direction.

As shown in FIG. 13, the bottom portion 507 of the present embodiment has a flat-plate shape perpendicular to the first direction. The bottom portion 507 is positioned at a lower end of the surrounding portion 506 in the first direction.

As shown in FIG. 13, the mating portion accommodating portion 508 of the present embodiment is a space extending in the first direction. The mating portion accommodating portion 508 is surrounded by the surrounding portion 506 in a direction perpendicular to the first direction. The mating portion accommodating portion 508 is positioned above the bottom portion 507 in the first direction.

Figure 9:
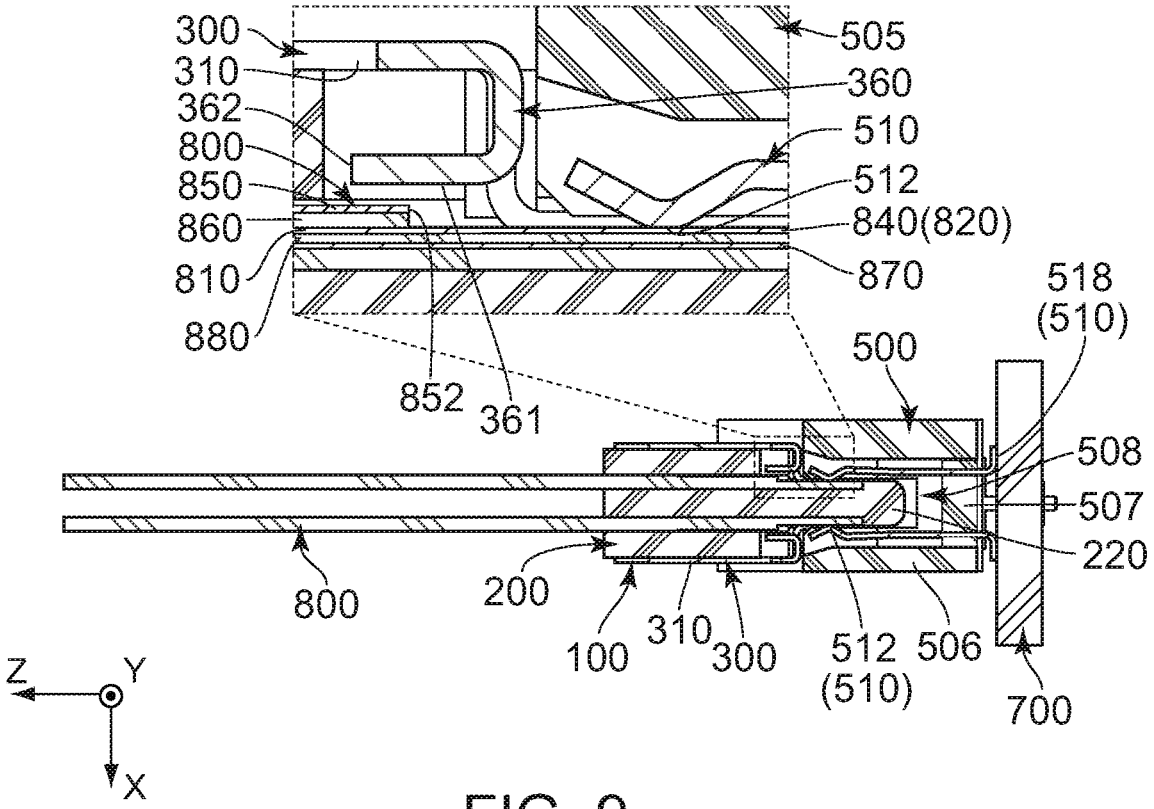
FIG. 9 is a cross-sectional view showing the connector assembly of FIG. 7, taken along line E-E.
Figure 14:
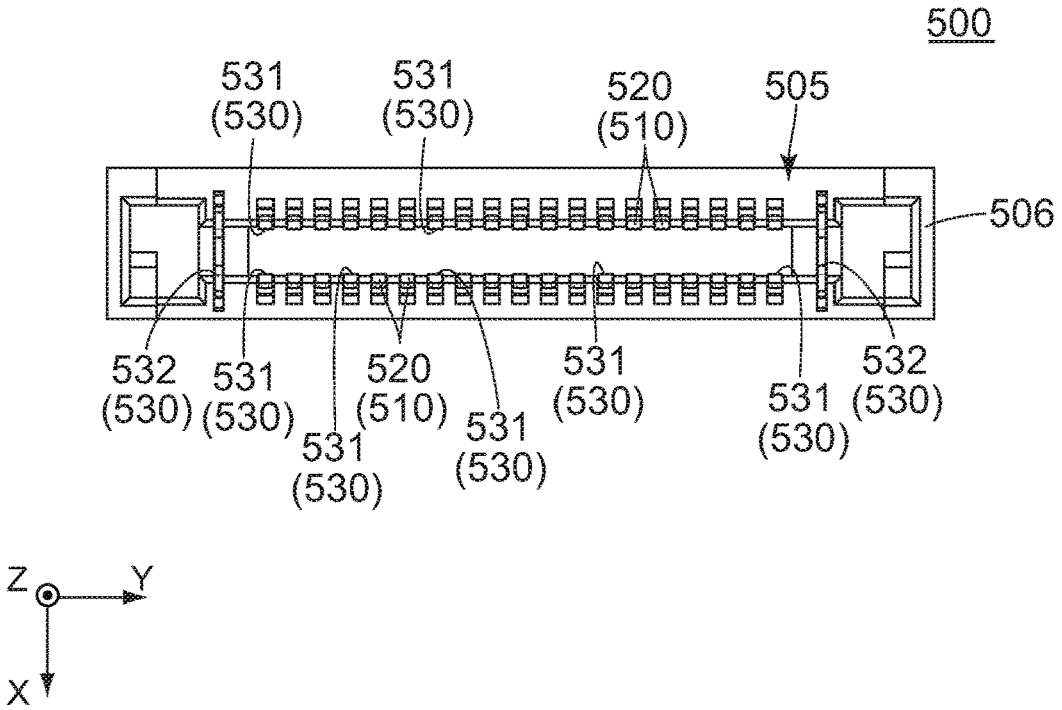
FIG. 14 is top view showing the mating connector of FIG. 11.

Referring to FIG. 9, each of the mating signal terminals 510 of the present embodiment is a terminal for surface mount technology (SMT). Specifically, each of the mating signal terminals 510 is configured to be fixed on a surface of the circuit board 700 by soldering or the like. Referring to FIG. 11, each of the mating signal terminals 510 is made of metal. The mating signal terminals 510 have the same shape as each other. As shown in FIG. 9, the mating signal terminals 510 are held by the mating holding member 505. More specifically, the mating signal terminals 510 are held by the bottom portion 507. As shown in FIG. 14, the mating signal terminals 510 are arranged in two rows. The mating signal terminals 510 of each of the two rows are arranged in a second direction. The mating signal terminals 510 of one of the two rows face the mating signal terminals 510 of a remaining one of the two rows in a third direction. In the present embodiment, the second direction is a Y-direction while the third direction is an X-direction. The mating signal terminals 510 include a plurality of differential pairs 520 each consisting of two of the mating signal terminals 510. However, the present invention is not limited thereto. The mating signal terminals 510 may include the mating signal terminals 510 constituting the differential pair 520 or may be terminals for single-ended transmission.

As shown in FIG. 9, each of the mating signal terminals 510 has a contact point 512 and a fixed portion 518.

Figure 4:
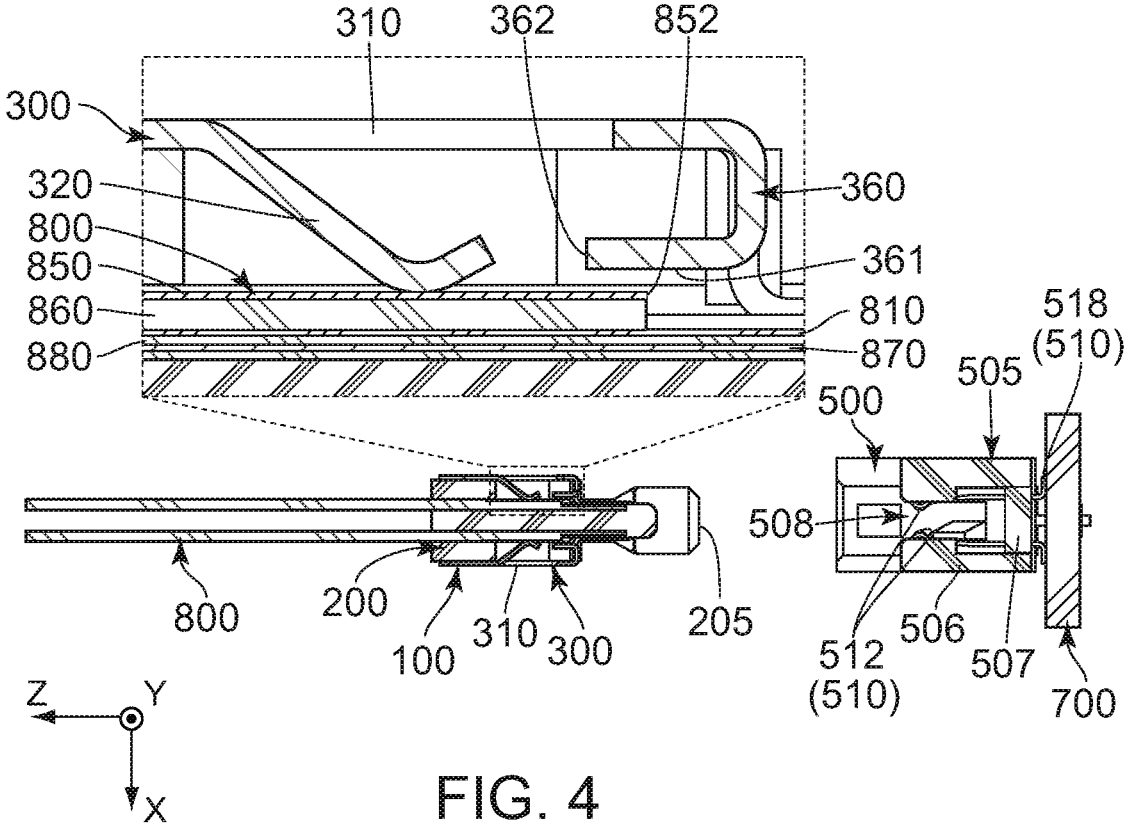
FIG. 4 is a cross-sectional view showing the connector assembly of FIG. 2, taken along line B-B.

As shown in FIG. 4, the contact point 512 of the present embodiment protrudes in the mating portion accommodating portion 508.

Referring to FIG. 4, the fixed portion 518 of the present embodiment is fixed on a pad (not shown) of the circuit board 700 when the mating connector 500 is mounted on the circuit board 700. The fixed portion 518 defines a lower end of the mating signal terminal 510. The fixed portion 518 extends outward in the third direction.

As shown in FIG. 14, the mating ground terminals 530 of the present embodiment are arranged in the second direction. The mating ground terminals 530 include a plurality of main mating ground terminals 531 and two auxiliary mating ground terminals 532. However, the present invention is not limited thereto. The mating ground terminals 530 may consist of only the main mating ground terminals 531.

Figure 3:
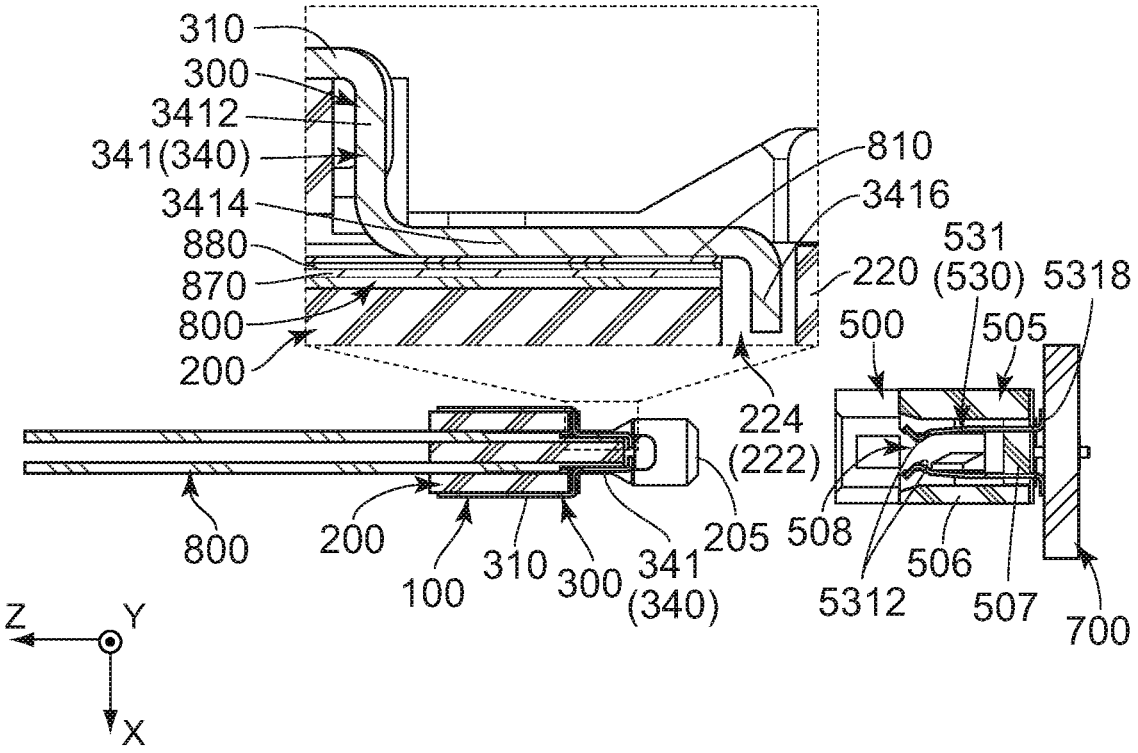
FIG. 3 is a cross-sectional view showing the connector assembly of FIG. 2, taken along line A-A.

As shown in FIG. 3, each of the main mating ground terminals 531 of the present embodiment is a terminal for SMT. Specifically, each of the main mating ground terminals 531 is configured to be fixed on the surface of the circuit board 700 by soldering or the like. Each of the main mating ground terminals 531 is made of metal. The main mating ground terminals 531 have the same shape as each other. Referring to FIGS. 3 and 9, the main mating ground terminal 531 has the same shape as the mating signal terminal 510. As shown in FIG. 3, the main mating ground terminals 531 are held by the mating holding member 505. More specifically, the main mating ground terminals 531 are held by the bottom portion 507. As shown in FIG. 14, the main mating ground terminals 531 are arranged in two rows. The main mating ground terminals 531 of each of the two rows are arranged in the second direction. The main mating ground terminals 531 of one of the two rows face the main mating ground terminals 531 of a remaining one of the two rows in the third direction. The main mating ground terminals 531 are arranged so that the two mating signal terminals 510 of each of the differential pairs 520 are put between the main mating ground terminals 531 in the second direction.

As shown in FIG. 13, each of the main mating ground terminals 531 has a contact point 5312 and a fixed portion 5318.

As shown in FIG. 13, the contact point 5312 protrudes in the mating portion accommodating portion 508. The contact point 5312 of the main mating ground terminals 531 is positioned at a position same as that of the contact point 512 (see FIG. 4) of the mating signal terminal 510 in the first direction.

As shown in FIG. 3, the fixed portion 5318 of the present embodiment is fixed on a pad (not shown) of the circuit board 700 when the mating connector 500 is mounted on the circuit board 700. The fixed portion 5318 defines a lower end of the main mating ground terminal 531. The fixed portion 5318 extends outward in the third direction.

Figure 5:
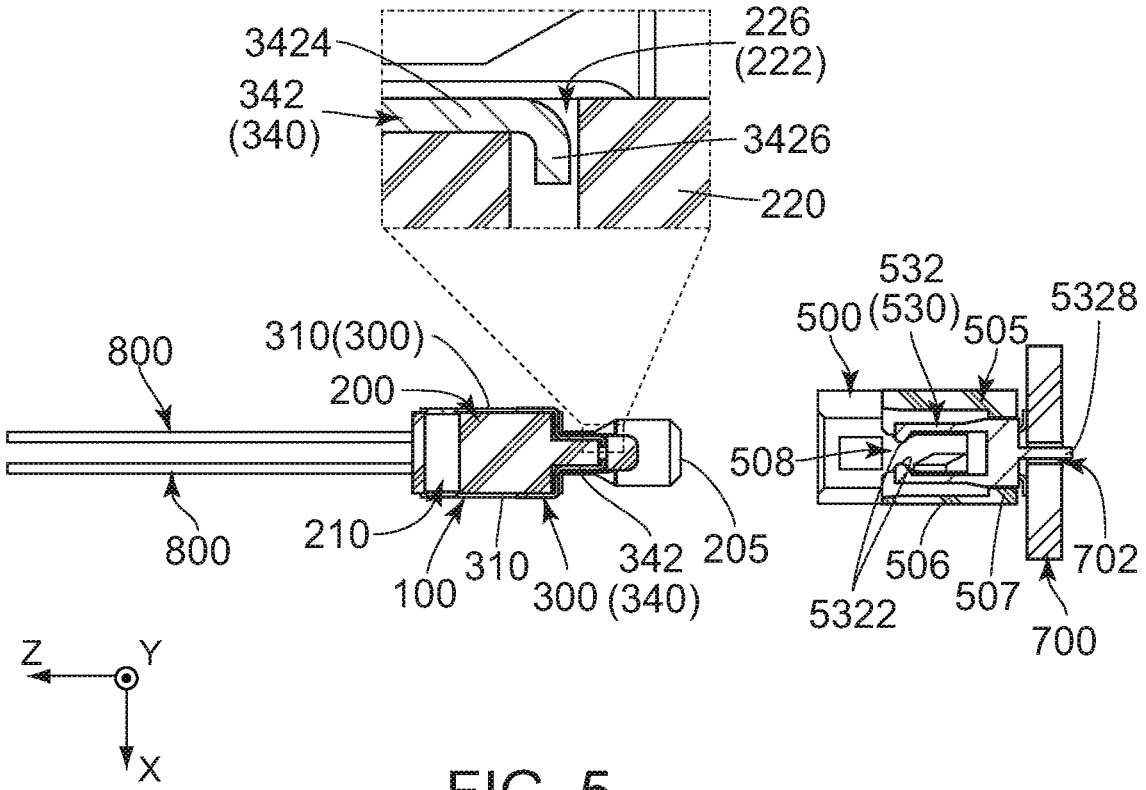
FIG. 5 is a cross-sectional view showing the connector assembly of FIG. 2, taken along line C-C.

As shown in FIG. 5, each of the auxiliary mating ground terminals 532 of the present embodiment is a terminal for through-hole technology (THT). Specifically, each of the auxiliary mating ground terminals 532 is configured to be inserted into a through hole 702, which is formed on the circuit board 700, to be fixed thereto by soldering or the like. Each of the auxiliary mating ground terminals 532 is made of metal. The auxiliary mating ground terminals 532 have the same shape as each other. Referring to FIGS. 3 and 5, the auxiliary mating ground terminal 532 has a shape different from that of the main mating ground terminal 531. As shown in FIG. 5, the auxiliary mating ground terminals 532 are held by the mating holding member 505. More specifically, the auxiliary mating ground terminals 532 are held by the bottom portion 507. As shown in FIG. 14, in the second direction, the auxiliary mating ground terminal 532 is positioned outward of the outermost one of the main mating ground terminals 531. The auxiliary mating ground terminals 532 are positioned around opposite ends, respectively, of the mating holding member 505 in the second direction.

As described above, the main mating ground terminal 531 of the present embodiment is the terminal for SMT and the auxiliary mating ground terminal 532 of the present embodiment is the terminal for THT. In addition, the auxiliary mating ground terminals 532 are positioned around the opposite ends, respectively, of the mating holding member 505 in the second direction. Thus, when the mating connector 500 is fixed on the circuit board 700, the mating connector 500 can be securely fixed on the circuit board 700 in comparison with an assumption where the mating connector 500 have no auxiliary mating ground terminal 532.

As shown in FIG. 13, each of the auxiliary mating ground terminals 532 has two contact points 5322 and a fixed portion 5328.

As shown in FIG. 13, each of the contact points 5322 of the present embodiment protrudes in the mating portion accommodating portion 508. The contact point 5322 of the auxiliary mating ground terminal 532 is positioned at a position same as that of the contact point 512 (see FIG. 4) of the mating signal terminal 510 in the first direction. The two contact points 5322 of the auxiliary mating ground terminal 532 face each other in the third direction.

As shown in FIG. 5, the fixed portion 5328 of the present embodiment is inserted into the through hole 702 of the circuit board 700 to be fixed on the surface thereof when the mating connector 500 is mounted on the circuit board 700. The fixed portion 5328 defines a lower end of the auxiliary mating ground terminal 532.

Figure 16:
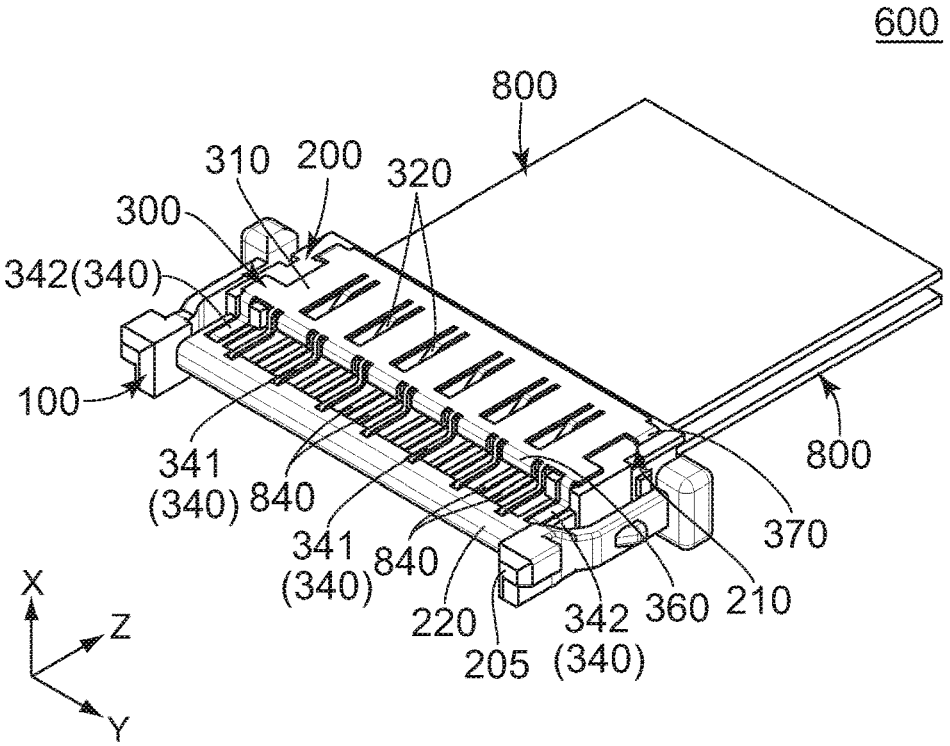
FIG. 16 is a perspective view showing the harness which is included in the connector assembly of FIG. 1.

As shown in FIG. 16, the harness 600 of the present embodiment comprises two connecting objects 800 and a connector 100.

Figure 6:
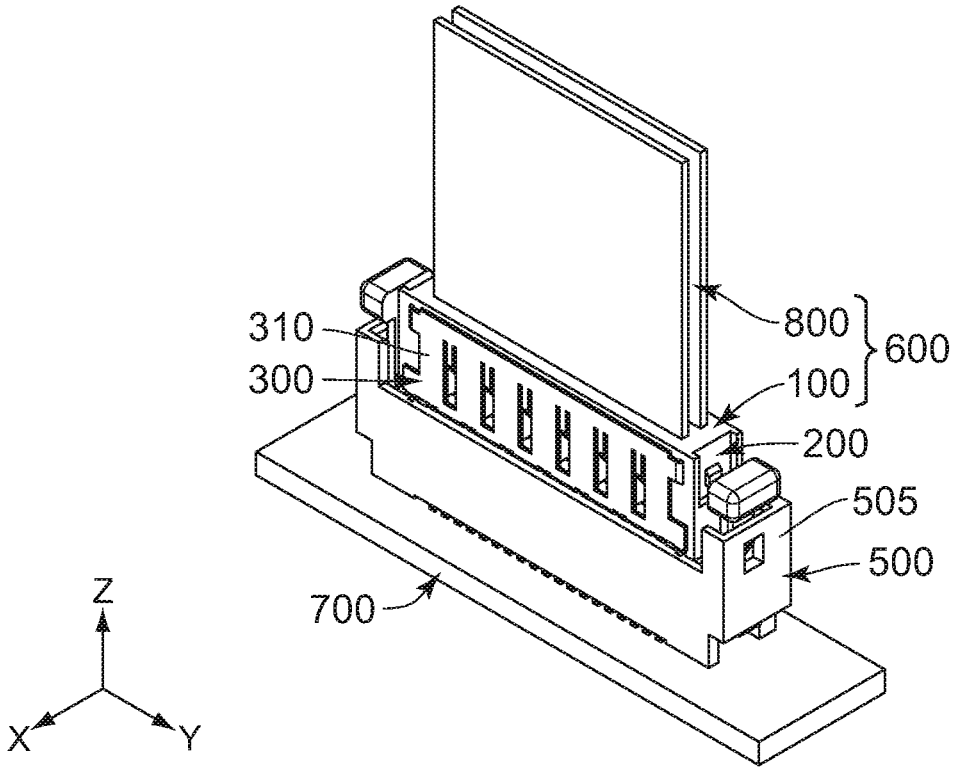
FIG. 6 is another perspective view showing the connector assembly of FIG. 1. In the figure, the connector of the harness is in a mated state where the connector is mated with the mating connector.
Figure 7:
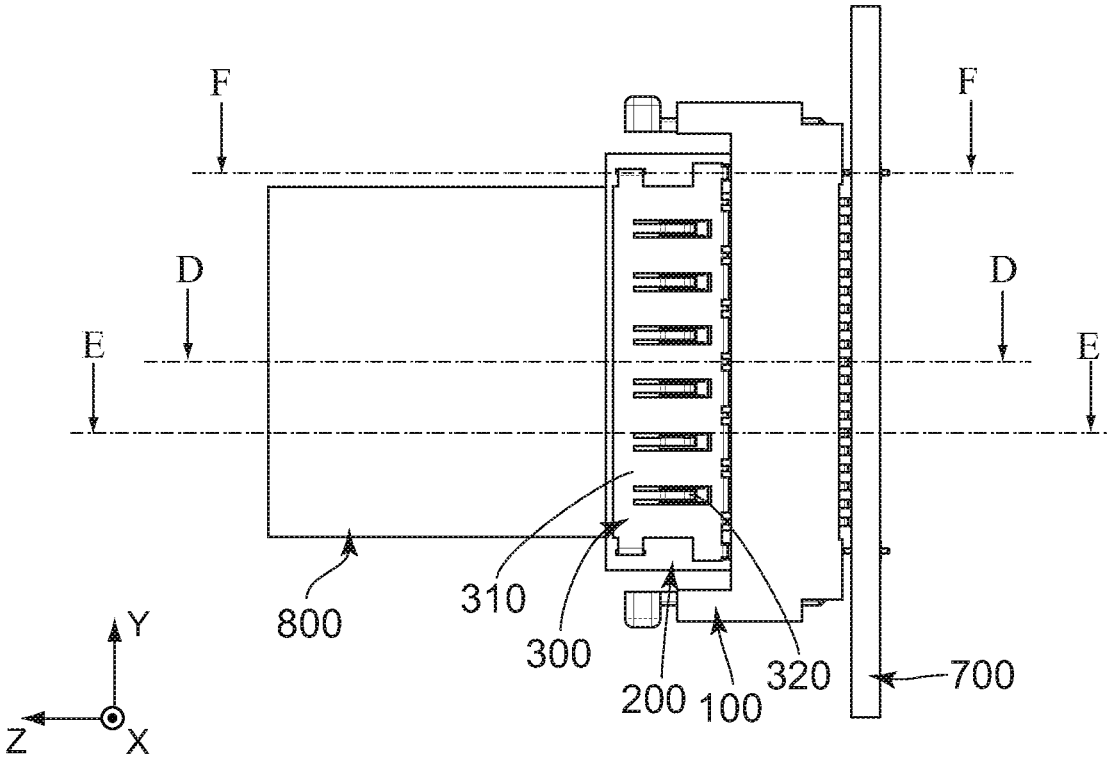
FIG. 7 is a front view showing the connector assembly of FIG. 6.
Figure 15:
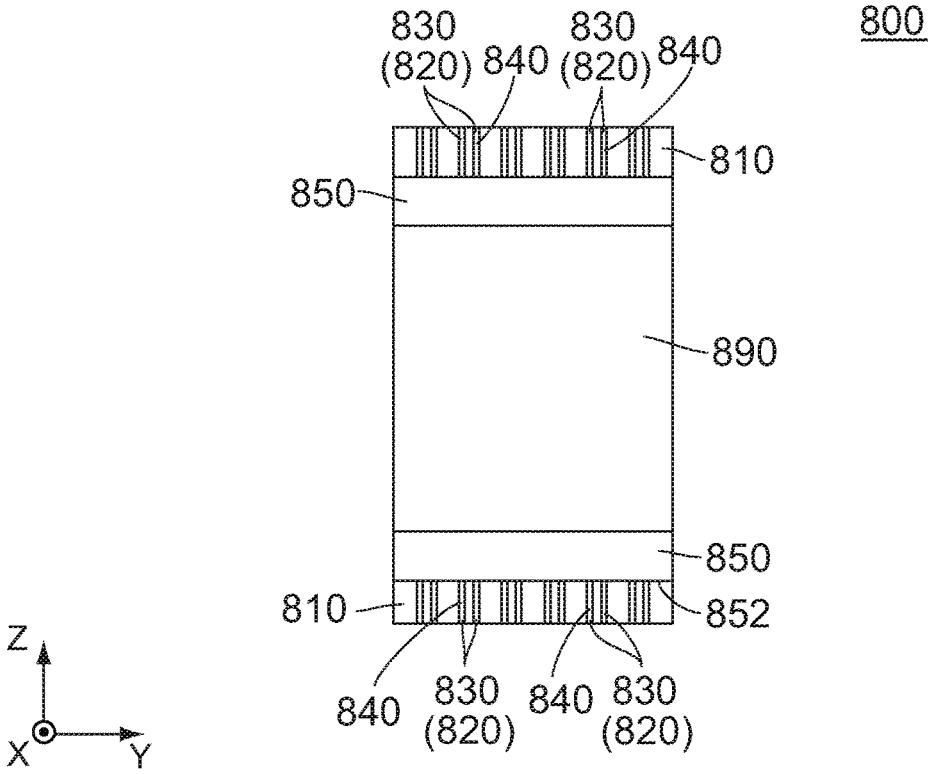
FIG. 15 is a view showing the connecting object which is included in the connector assembly of FIG. 1.

Referring to FIGS. 6 and 15, the connecting object 800 of the present embodiment is used for connection to a device such as an electronic equipment. In detail, the connecting object 800 is used for connection to a device having at least two ground pins and at least one signal pin which is arranged between two of the ground pins in a pitch direction. Specifically, the connecting object 800 is used for connection to a device which is provided with the mating connector 500, wherein: the ground pin is the mating ground terminal 530; the signal pin is the mating signal terminal 510; and the pitch direction is the Y-direction.

Referring to FIGS. 4 and 15, each of the connecting objects 800 has a sheet-like shape. More specifically, each of the connecting objects 800 is a Flexible Flat Cable (FFC). However, the present invention is not limited thereto. The connecting object 800 may be a Flexible Printed Circuit (FPC). The two connecting objects 800 has the same structure as each other. The connecting object 800 is configured to be attached with the connector 100.

Figure 8:
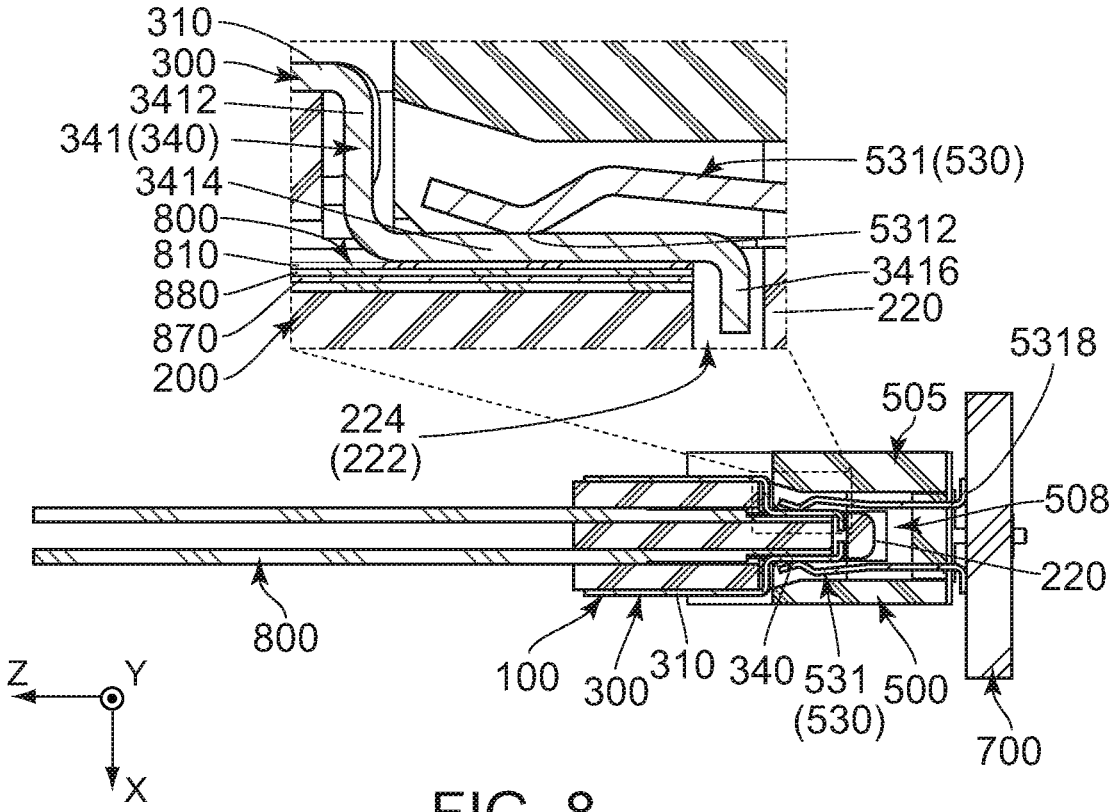
FIG. 8 is a cross-sectional view showing the connector assembly of FIG. 7, taken along line D-D.

Referring to FIGS. 8, 9 and 15, a transmission line of the connecting object 800 is configured as a microstrip transmission line or strip transmission line. Specifically, the connecting object 800 has a wiring layer 810, a shield layer 850, an additional shield layer 870, a first insulator 860, a second insulator 880 and a third insulator 890. In the present application, the shield layer 850 is also referred to as a conductive layer. However, the present invention is not limited thereto. The connecting object 800 may have no additional shield layer 870.

As understood from FIGS. 9 and 15, the wiring layer 810 of the present embodiment extends in a plane perpendicular to the third direction which is perpendicular to both the first direction and the second direction. As shown in FIG. 9, the wiring layer 810 is positioned between the shield layer 850 and the additional shield layer 870 in the third direction perpendicular to both the first direction and the second direction. More specifically, the wiring layer 810 is positioned between the first insulator 860 and the second insulator 880 in the third direction. As shown in FIG. 15, the wiring layer 810 includes a plurality of signal lines 820. In the present application, the signal line 820 is also referred to as a trace. However, the present invention is not limited thereto. The wiring layer 810 should include at least one signal line 820. The wiring layer 810 is formed with only the signal lines 820 which are configured to be connected with the signal pins, respectively, of the device. The wiring layer 810 is formed with no ground line which is configured to be connected with the ground pin of the device. However, the present invention is not limited thereto. The wiring layer 810 may be provided with a conductive line at an area which would correspond to a ground line of a coplanar transmission line if the coplanar transmission line was formed on the wiring layer 810, provided that the conductive line is not grounded and is electrically floated.

Referring to FIGS. 14 and 15, the signal lines 820 of the present embodiment include a plurality of differential pairs each consisting of two of the signal lines 820, wherein the two signal lines 820 of the differential pair correspond to the mating signal terminals 510 which constitutes the differential pair 520. In other words, the signal lines 820 include the differential pairs 830 each consisting of the two signal lines 820, and the differential pairs 830 correspond to the differential pairs 520 (see FIG. 14), respectively, of the mating signal terminals 510. However, the present invention is not limited thereto. The signal lines 820 may include the two signal lines 820 constituting the differential pair 830 or may be lines for single-ended transmission. If the signal lines 820 include the two signal lines 820 constituting the differential pair 830, the mating signal terminals 510 include the two mating signal terminals 510 which correspond to the differential pair 830.

As shown in FIG. 15, each of the signal lines 820 has a signal contact portion 840. In the present application, the signal contact portion 840 is also referred to as a first contact portion.

As shown in FIG. 16, the signal contact portion 840 of the present embodiment is exposed to the outside of the connecting object 800. More specifically, the signal contact portion 840 is exposed to the outside of the connecting object 800 in the third direction.

As shown in FIG. 9, when the connector 100 is mated with the mating connector 500 while being in an attached state where the connector 100 is attached with the connecting object 800, the signal contact portion 840 is brought into contact with the mating signal terminal 510. In other words, the signal contact portion 840 is brought into contact with the mating signal terminal 510 under a mated state where the connector 100 in the attached state is mated with the mating connector 500. In detail, the signal contact portion 840 is brought into contact with the contact point 512 of the mating signal terminal 510 under the mated state.

Referring to FIGS. 9 and 15, the shield layer 850 of the present embodiment extends in the plane perpendicular to the third direction. As shown in FIG. 9, the shield layer 850 covers the wiring layer 810 via the first insulator 860 which is positioned between the shield layer 850 and the wiring layer 810. The shield layer 850 is positioned outward of the first insulator 860 in the third direction. A part of the shield layer 850 is exposed to the outside of the connecting object 800. More specifically, as shown in FIG. 15, opposite ends of the shield layer 850 in the first direction and their vicinities are exposed to the outside of the connecting object 800. A remaining part of the shield layer 850 is covered by the third insulator 890.

Referring to FIG. 9, the additional shield layer 870 of the present embodiment extends in the plane perpendicular to the third direction. The additional shield layer 870 covers the wiring layer 810 via the second insulator 880 which is positioned between the additional shield layer 870 and the wiring layer 810. The additional shield layer 870 is positioned inward of the second insulator 880 in the third direction. The additional shield layer 870 is not exposed to the outside of the connecting object 800. The additional shield layer 870 is grounded.

As shown in FIG. 16, the connector 100 of the present embodiment is configured to be attached with the connecting object 800 having the sheet-like shape. In the harness 600 of the present embodiment, the connector 100 is attached with the connecting objects 800. Referring to FIGS. 1 and 6, the connector 100 is mateable with the mating connector 500 along the first direction.

Figure 21:
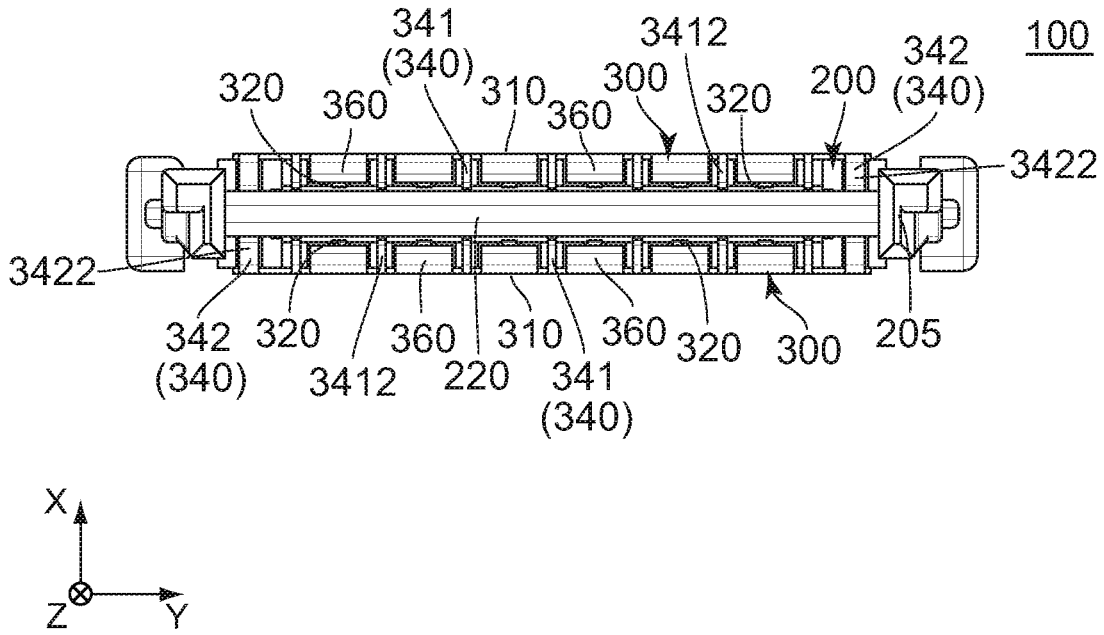
FIG. 21 is a bottom view showing the connector of FIG. 19.

As shown in FIG. 21, the connector 100 comprises a holding member 200 and two ground members 300. In the present application, the ground member 300 is also referred to as a conductive member.

As shown in FIG. 16, the holding member 200 partially holds the connecting object 800 under the attached state.

Figure 19:
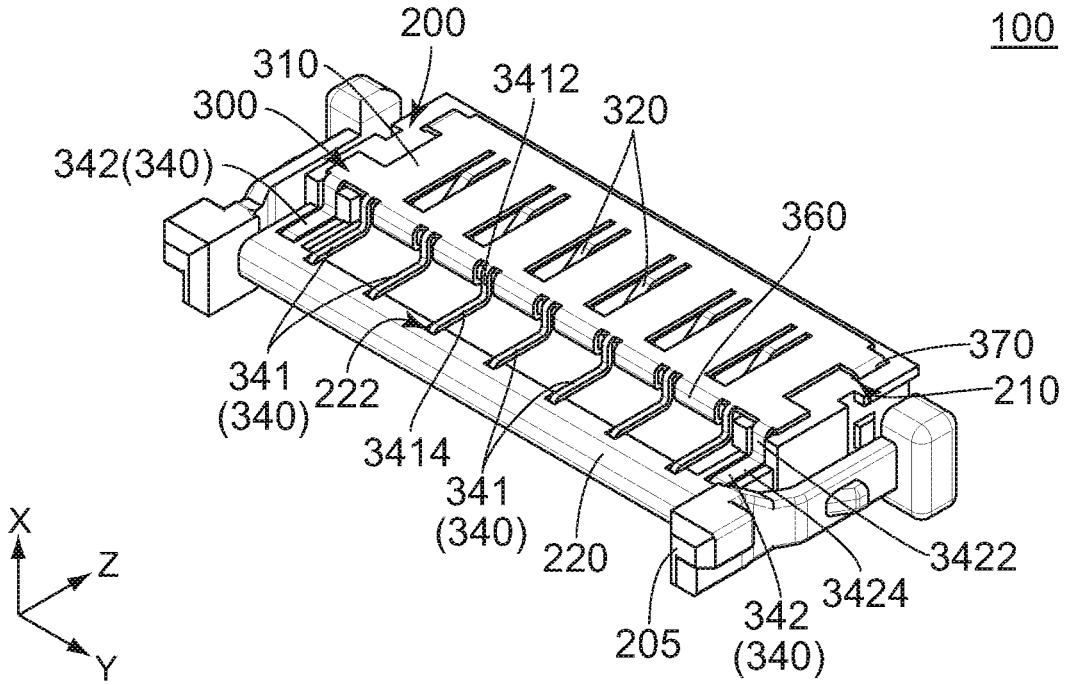
FIG. 19 is a perspective view showing the connector which is included in the harness of FIG. 16.

Referring to FIG. 19, the holding member 200 is made of insulator. Specifically, the holding member 200 has a mating portion 205 and two main portion holding portions 210.

Figure 10:
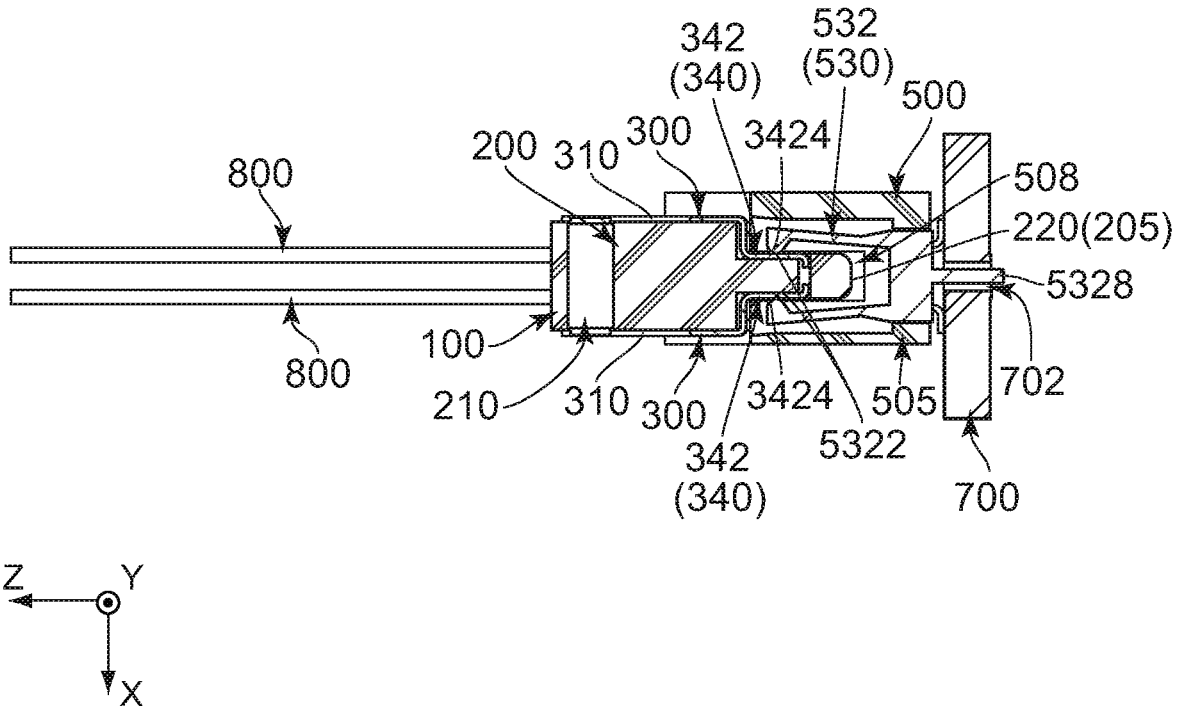
FIG. 10 is a cross-sectional view showing the connector assembly of FIG. 7, taken along line F-F.
Figure 20:
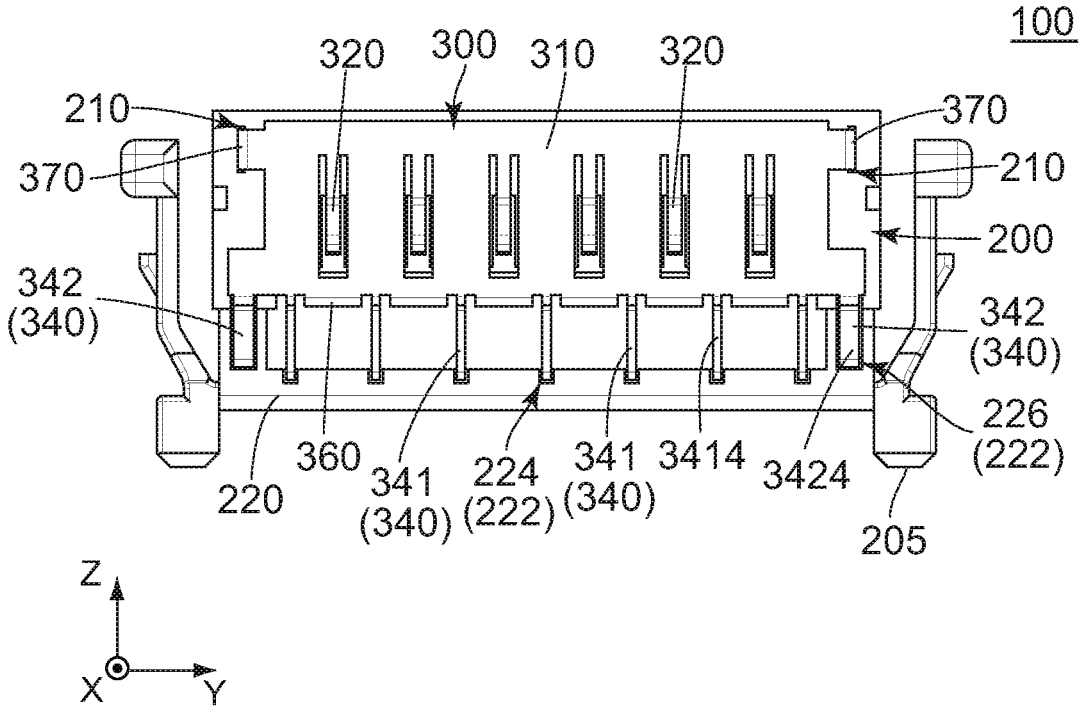
FIG. 20 is a front view showing the connector of FIG. 19.

As shown in FIG. 20, the mating portion 205 of the present embodiment defines a lower end of the connector 100. As shown in FIG. 10, the mating portion 205 is accommodated in the mating portion accommodating portion 508 when the connector 100 is mated with the mating connector 500.

As shown in FIG. 20, the mating portion 205 has a guard portion 220.

Figure 17:
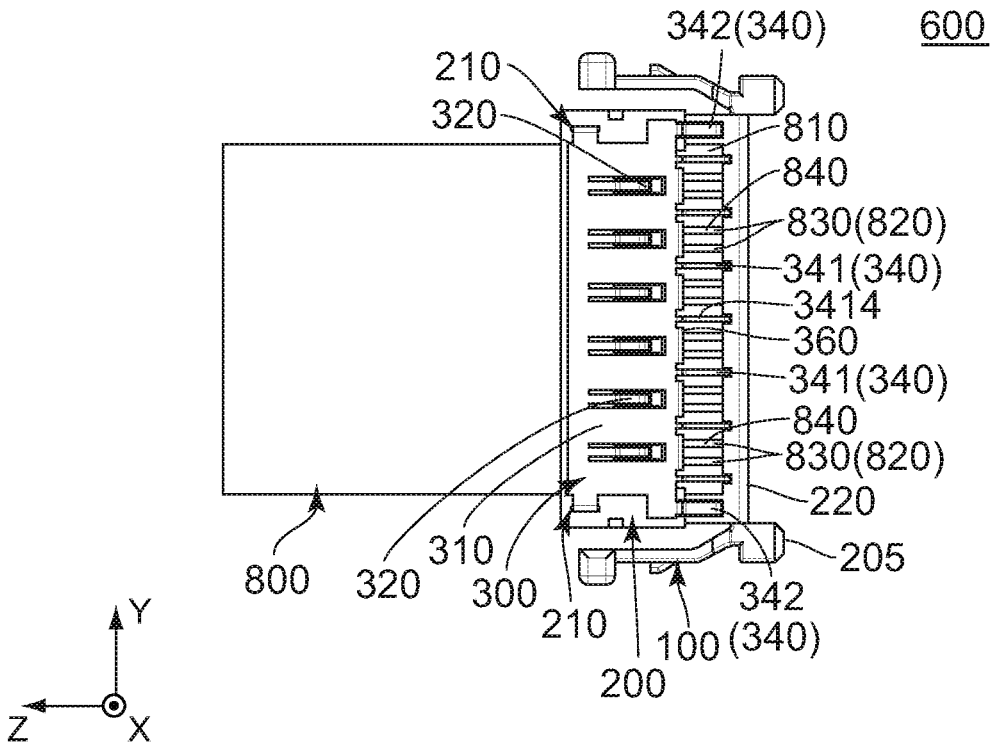
FIG. 17 is a front view showing the harness of FIG. 16.
Figure 18:
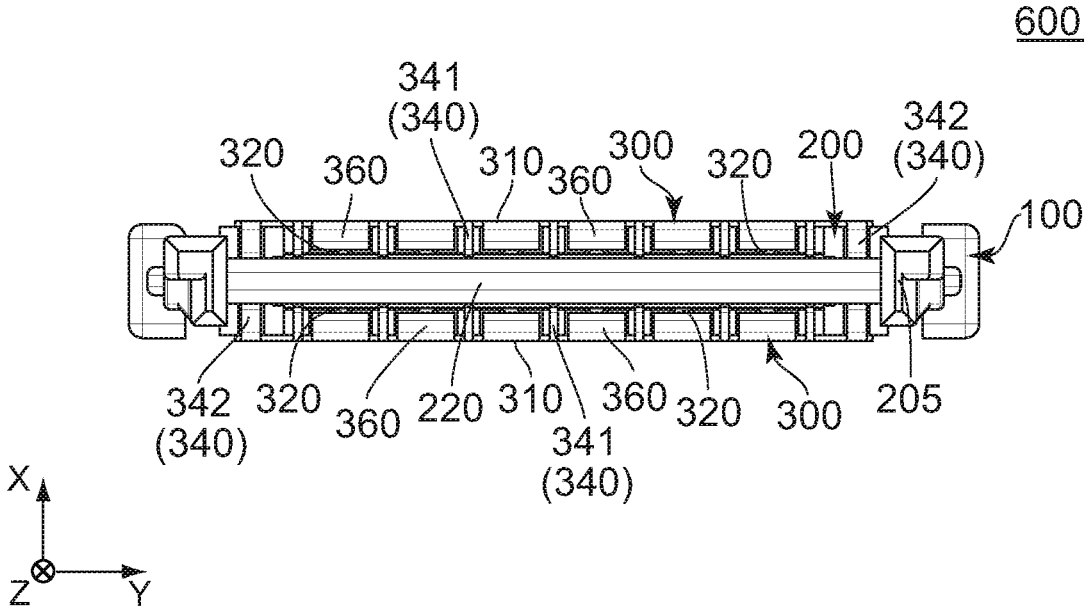
FIG. 18 is a bottom view showing the harness of FIG. 16.

As shown in FIG. 20, the guard portion 220 of the present embodiment extends in the second direction. The guard portion 220 is positioned below the main portion holding portion 210 in the first direction. As shown in FIG. 17, the guard portion 220 is positioned below the signal contact portion 840 of the connecting object 800 in the first direction under the attached state.

As shown in FIG. 20, the guard portion 220 has a plurality of end portion accommodating portions 222.

As shown in FIG. 20, the end portion accommodating portions 222 of the present embodiment are arranged in the second direction. As shown FIGS. 3 and 5, each of the end portion accommodating portions 222 is a hole piercing the guard portion 220 in the third direction. As shown in FIG. 20, the end portion accommodating portions 222 include a plurality of main end portion accommodating portions 224 and two auxiliary end portion accommodating portions 226.

As shown in FIG. 20, the main end portion accommodating portions 224 of the present embodiment are arranged in the second direction. The main end portion accommodating portions 224 are positioned between the two auxiliary end portion accommodating portions 226 in the second direction.

As shown in FIG. 20, the auxiliary end portion accommodating portions 226 of the present embodiment are positioned around opposite ends, respectively, of the guard portion 220 in the second direction. In the second direction, each of the auxiliary end portion accommodating portions 226 is positioned outward of the outermost one of the main end portion accommodating portions 224.

As shown in FIG. 10, each of the main portion holding portions 210 of the present embodiment is a hole piercing the holding member 200 in the third direction. As shown in FIG. 20, the main portion holding portions 210 are positioned around opposite ends, respectively, of the holding member 200 in the second direction. Each of the main portion holding portions 210 is positioned around an upper end of the holding member 200.

Figure 22:
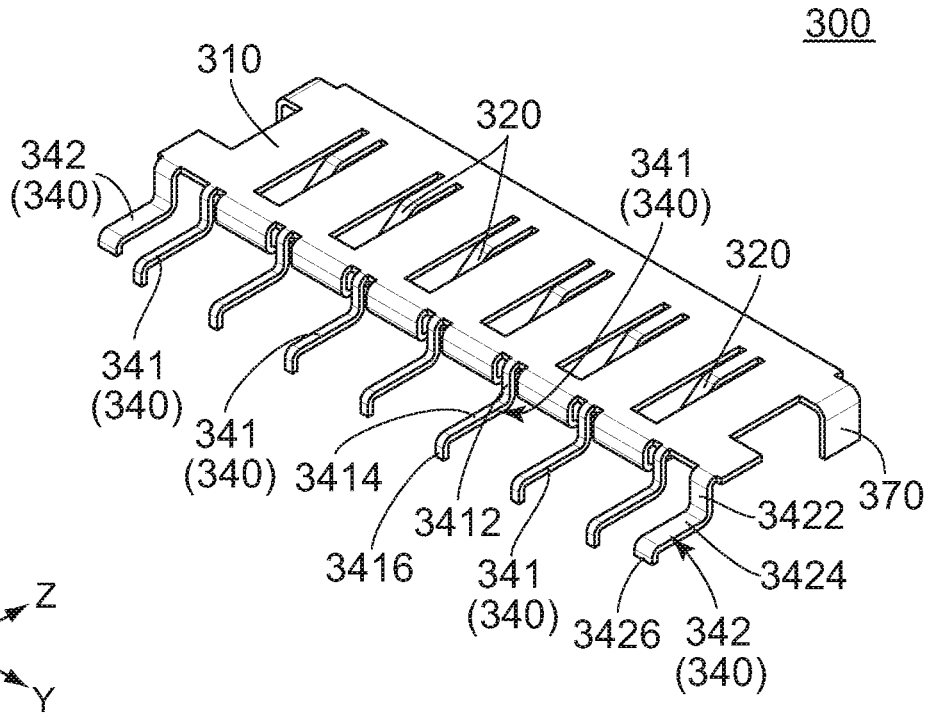
FIG. 22 is a perspective view showing one of the ground members which are included in the connector of FIG. 19.

Referring to FIG. 22, each of the ground members 300 of the present embodiment is made of metal. Referring to FIGS. 3 to 5, the two ground members 300 have the same structure as each other. Each of the ground members 300 is attached with the holding member 200. More specifically, the two ground members 300 are attached with the holding member 200 so as to be mirror-symmetric with each other to a plane, wherein the plane is perpendicular to the third direction while passing through a middle of the connector 100 in the third direction.

Figure 23:
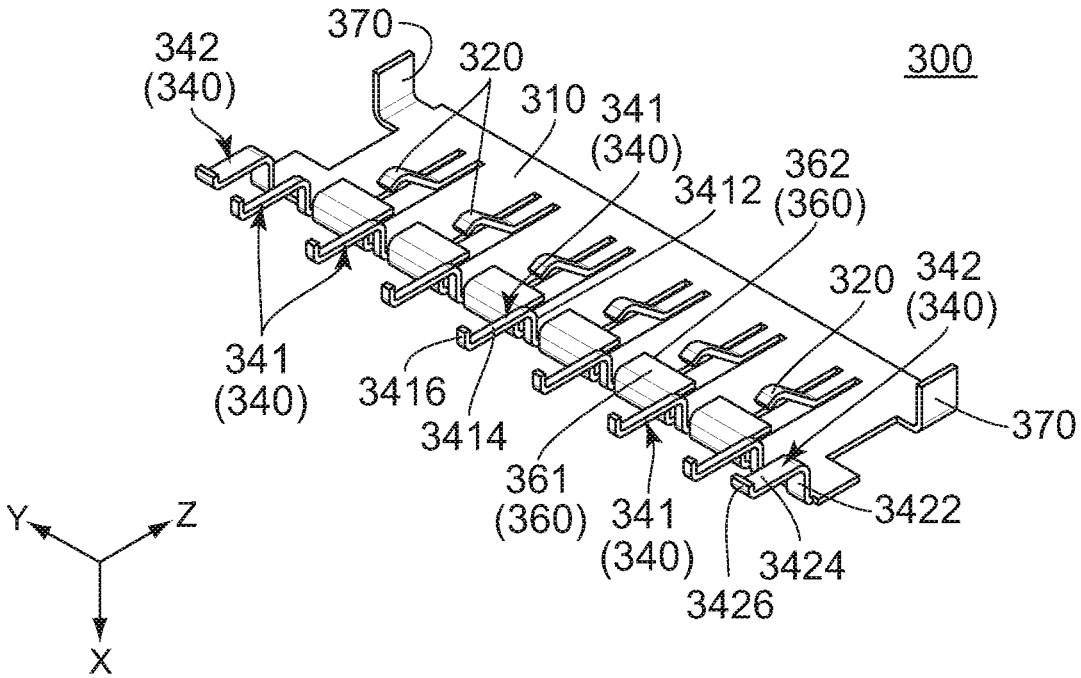
FIG. 23 is another perspective view showing the ground member of FIG. 22.

As shown in FIGS. 22 and 23, each of the ground members 300 has a main portion 310 having a flat-plate shape, a plurality of contact springs 320, a plurality of ground contact portions 340, a plurality of bent portions 360 and two held portions 370. However, the present invention is not limited thereto. The ground member 300 should have at least one contact spring 320 and at least two ground contact portions 340. In the present embodiment, the ground contact portion 340 is also referred to as a second contact portion.

As shown in FIG. 3, the wiring layer 810 has areas which correspond to the ground contact portions 340, respectively, in the second direction, and each of the areas of the wiring layer 810 is provided with no conductive member.

As shown in FIGS. 22 and 23, the main portion 310 of the present embodiment has the flat-plate shape perpendicular to the third direction. As shown in FIG. 3, the main portion 310 is positioned outward of the holding member 200 in the third direction.

Figure 28:
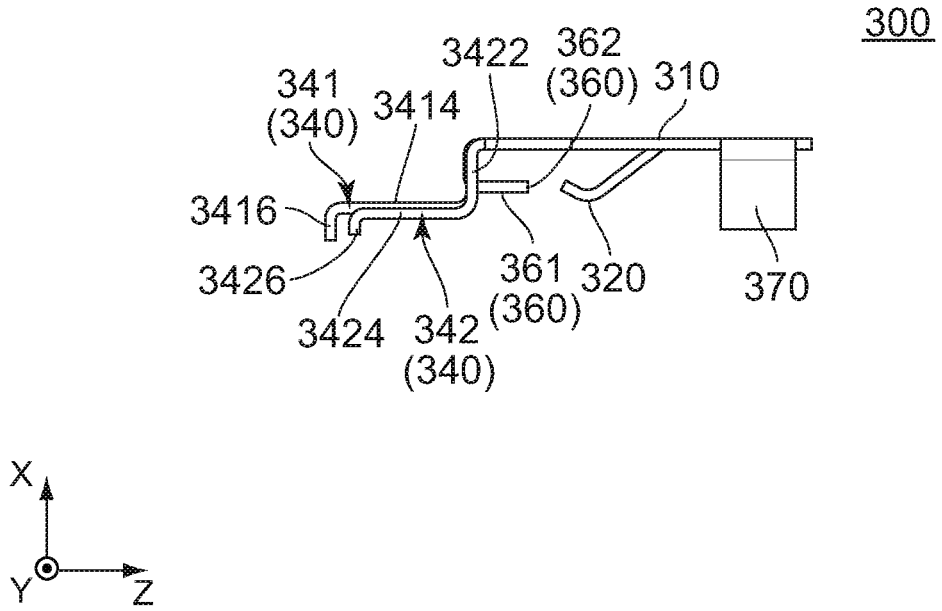
FIG. 28 is a side view showing the ground member of FIG. 22.

As shown in FIGS. 23 and 28, each of the contact springs 320 of the present embodiment extends in the first direction. More specifically, the contact spring 320 extends downward in the first direction and inward in the third direction. The contact spring 320 extends from the main portion 310. More specifically, the contact spring 320 extends downward in the first direction and inward in the third direction from the main portion 310. As shown in FIG. 28, the contact spring 320 is positioned above the ground contact portion 340 in the first direction. As shown in FIG. 4, the contact spring 320 is brought into contact with the shield layer 850 under the attached state. More specifically, the contact spring 320 is brought into contact with the shield layer 850 of the connecting object 800 at a place which is positioned inward of the main portion 310 in the third direction perpendicular to both the first direction and the second direction.

As shown in FIGS. 22 and 23, each of the ground contact portions 340 of the present embodiment extends in the first direction from the main portion 310. More specifically, each of the ground contact portions 340 extends inward in the third direction from the main portion 310, then extends downward, and further extends inward in the third direction. Since each of the ground contact portions 340 extends from the common main portion 310, the ground contact portions 340 are commonly grounded and resistance to ground potential is reduced.

Figure 24:
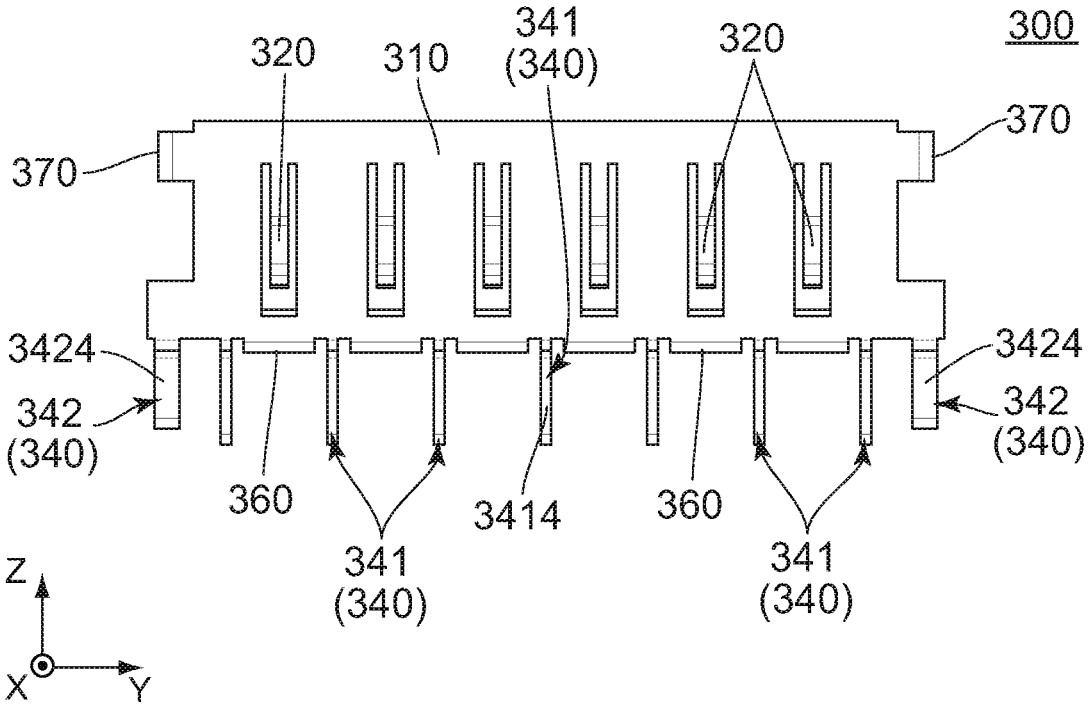
FIG. 24 is a front view showing the ground member of FIG. 22.

As shown in FIG. 24, the ground contact portions 340 are arranged in the second direction. Referring to FIG. 3, the ground contact portions 340 correspond to the end portion accommodating portions 222, respectively. A part of each of the ground contact portions 340 is accommodated in the end portion accommodating portion 222 corresponding thereto.

As shown in FIGS. 8 and 10, when the connector 100 is mated with the mating connector 500, the ground contact portions 340 are brought into contact with the mating ground terminals 530, respectively. In other words, the ground contact portions 340 are brought into contact with the mating ground terminals 530, respectively, under the mated state.

As described above, the contact spring 320 is brought into contact with the shield layer 850 under the attached state. Additionally, as described above, when the connector 100 in the attached state is mated with the mating connector 500, the signal contact portions 840 are brought into contact with the mating signal terminals 510, respectively, while the ground contact portions 340 are brought into contact with the mating ground terminals 530, respectively. In other words, when the connector 100 in the attached state is mated with the mating connector 500, the shield layer 850 is connected with the mating ground terminals 530 via the ground member 300. This enables the connector 100 of the present embodiment to be configured so that, when the connector 100 is mated with the mating connector 500 while being in the attached state where the connector 100 is attached with the connecting object 800, the mating ground terminals 530 are connected with the shield layer 850 of the connecting object 800 whose transmission line is configured as a microstrip transmission line or strip transmission line. If the connecting object 800 has the additional shield layer 870, the transmission line of the connecting object 800 functions as a strip transmission line. If the connecting object 800 does not have the additional shield layer 870, the transmission line of the connecting object 800 functions as a microstrip transmission line.

As shown in FIGS. 22 and 23, the ground contact portions 340 include a plurality of main ground contact portions 341 and two auxiliary ground contact portions 342.

As shown in FIGS. 22 and 23, the main ground contact portions 341 of the present embodiment have the same shape as each other. As shown in FIG. 24, the main ground contact portions 341 are arranged in the second direction. The main ground contact portions 341 are positioned between the two auxiliary ground contact portions 342 in the second direction. The main ground contact portions 341 correspond to the main end portion accommodating portions 224, respectively.

As shown in FIG. 8, when the connector 100 is mated with the mating connector 500, the main ground contact portions 341 are brought into contact with the main mating ground terminals 531, respectively. In other words, the main ground contact portions 341 are brought into contact with the main mating ground terminals 531, respectively, under the mated state. More specifically, the main ground contact portions 341 are brought into contact with the contact points 5312 of the main mating ground terminals 531, respectively, under the mated state.

As shown in FIG. 22, each of the main ground contact portions 341 has a first portion 3412, a second portion 3414 and a third portion 3416.

As shown in FIGS. 22 and 23, the first portion 3412 of the present embodiment extends in the third direction. More specifically, the first portion 3412 extends inward in the third direction from a lower end of the main portion 310.

As shown in FIGS. 22 and 23, the second portion 3414 of present embodiment extends in the first direction. More specifically, the second portion 3414 extends downward in the first direction from an inner end of the first portion 3412 in the third direction. As shown in FIG. 28, the second portion 3414 is positioned inward of the contact spring 320 in the third direction.

As shown in FIG. 8, when the connector 100 is mated with the mating connector 500, the second portions 3414 are brought into the main mating ground terminals 531, respectively. In other words, the second portions 3414 are brought into contact with the main mating ground terminals 531, respectively, under the mated state. More specifically, the second portions 3414 are brought into contact with the contact points 5312 of the main mating ground terminals 531, respectively, under the mated state.

As shown in FIGS. 22 and 23, the third portion 3416 of the present embodiment extends inward in the third direction. More specifically, the third portion 3416 extends inward in the third direction from a lower end of the second portion 3414. An inner end of the third portion 3416 in the third direction is also an end of the main ground contact portion 341. As shown in FIG. 8, the third portion 3416 of each of the main ground contact portions 341 is accommodated in the main end portion accommodating portion 224 corresponding thereto. The third portion 3416 is positioned above a lower end of the guard portion 220 in the first direction.

As shown in FIGS. 22 and 23, the auxiliary ground contact portions 342 of the present embodiment have the same shape as each other. In the second direction, the auxiliary ground contact portion 342 has a size greater than a size of the main ground contact portion 341. The auxiliary ground contact portions 342 are positioned around opposite ends, respectively, of the ground member 300 in the second direction. The auxiliary ground contact portions 342 correspond to the auxiliary end portion accommodating portions 226, respectively.

As shown in FIG. 10, when the connector 100 is mated with the mating connector 500, the auxiliary ground contact portion 342 is brought into contact with one of the contact points 5322 of the auxiliary mating ground terminal 532. In other words, the auxiliary ground contact portion 342 is brought into contact with the one of the contact points 5322 of the auxiliary mating ground terminal 532 under the mated state.

As shown in FIG. 22, the auxiliary ground contact portion 342 has a first portion 3422, a second portion 3424 and a third portion 3426.

As shown in FIGS. 22 and 23, the first portion 3422 of the present embodiment extends in the third direction. More specifically, the first portion 3422 extends inward in the third direction from the lower end of the main portion 310.

As shown in FIGS. 22 and 23, the second portion 3424 of the present embodiment extends in the first direction. More specifically, the second portion 3424 extends downward in the first direction from an inner end of the first portion 3422 in the third direction. As shown in FIG. 28, the second portion 3424 is positioned inward of the contact spring 320 in the third direction.

As shown in FIG. 10, when the connector 100 is mated with the mating connector 500, the second portion 3424 is brought into contact with one of the contact points 5322 of the auxiliary mating ground terminal 532. In other words, the second portion 3424 is brought into contact with the one of the contact points 5322 of the auxiliary mating ground terminal 532 under the mated state.

As shown in FIGS. 22 and 23, the third portion 3426 of the present embodiment extends inward in the third direction. More specifically, the third portion 3426 extends inward in the third direction from a lower end of the second portion 3424. An inner end of the third portion 3426 in the third direction is also an end of the auxiliary ground contact portion 342. As shown in FIG. 5, the third portion 3426 of each of the auxiliary ground contact portions 342 is accommodated in the auxiliary end portion accommodating portion 226 corresponding thereto. The third portion 3426 is positioned above the lower end of the guard portion 220 in the first direction.

As shown in FIG. 17, each of the signal contact portions 840 of the signal lines 820 are positioned between two of the ground contact portions 340 in the second direction perpendicular to the first direction. The two signal lines 820 of each of the differential pairs 830 are positioned between two of the ground contact portions 340 in the second direction. Each of the signal contact portions 840 of the signal lines 820 are positioned between two of the main ground contact portions 341 in the second direction. The two signal lines 820 of each of the differential pairs 830 are positioned between two of the main ground contact portions 341 in the second direction. Each of the signal contact portions 840 of the signal lines 820 is positioned between two of the second portions 3414 in the second direction. The two signal lines 820 of each of the differential pairs 830 are positioned between two of the second portions 3414 in the second direction. However, the present invention is not limited thereto. The signal contact portion 840 of at least one of the signal lines 820 should be positioned between two of the ground contact portions 340 in the second direction perpendicular to the first direction. Specifically, the signal contact portion 840 of at least one of the signal lines 820 should be positioned between two of the ground contact portions 340 in the second direction perpendicular to the first direction under the attached state.

Figure 25:
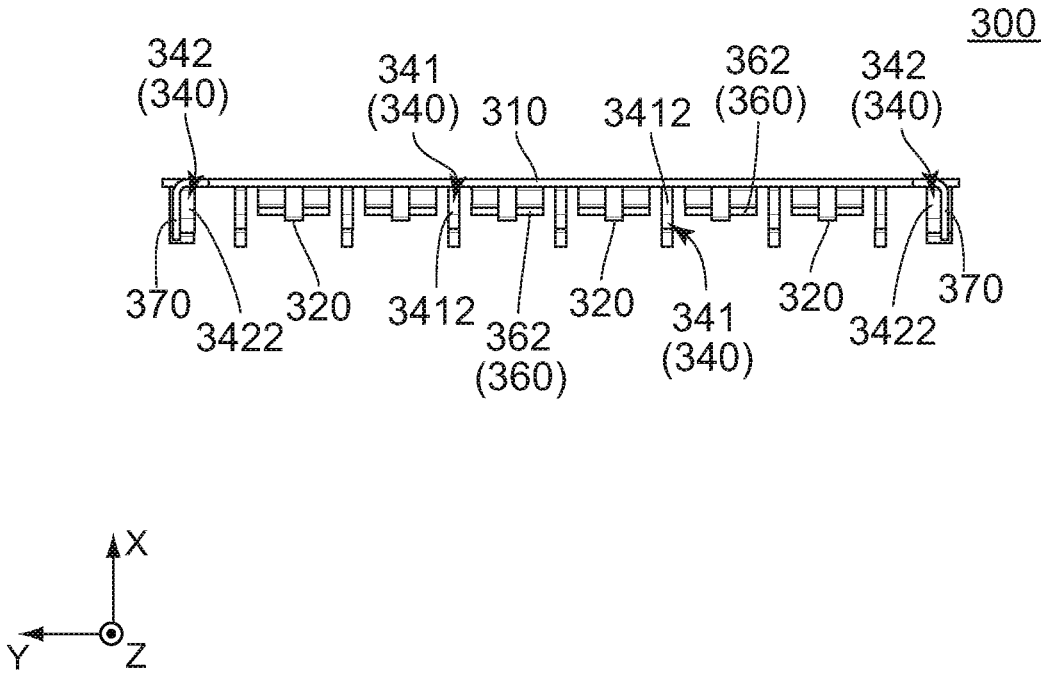
FIG. 25 is a top view showing the ground member of FIG. 22.
Figure 26:
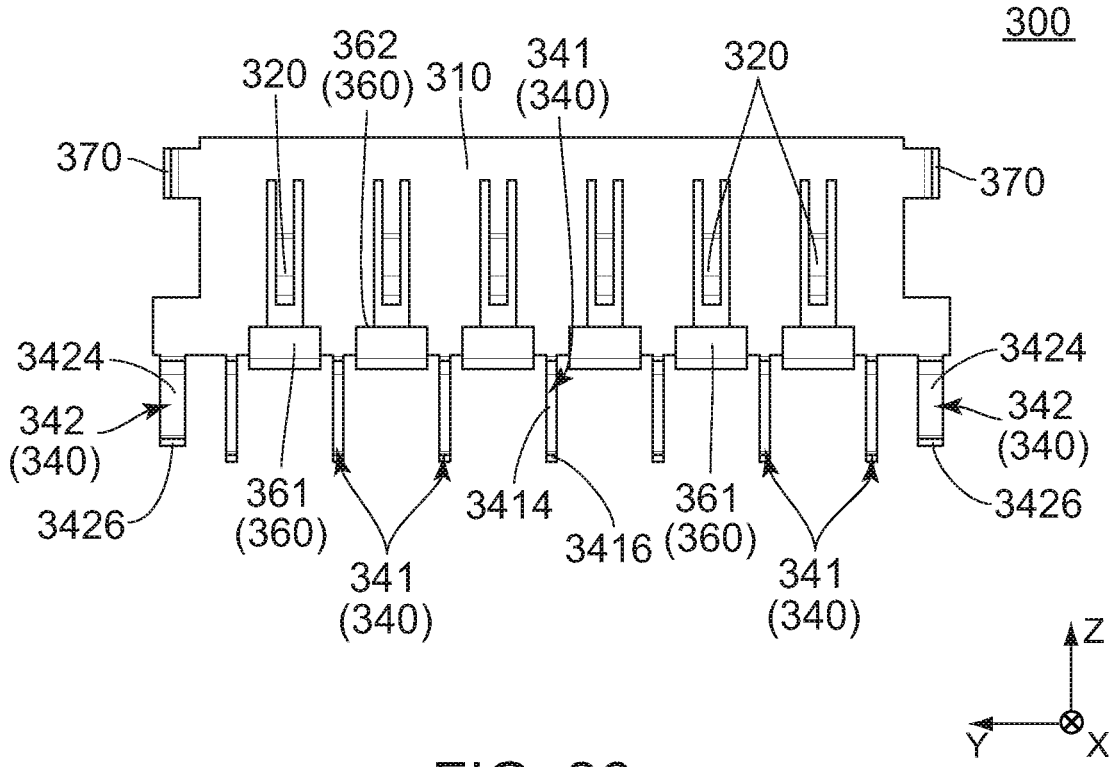
FIG. 26 is a rear view showing the ground member of FIG. 22.
Figure 27:
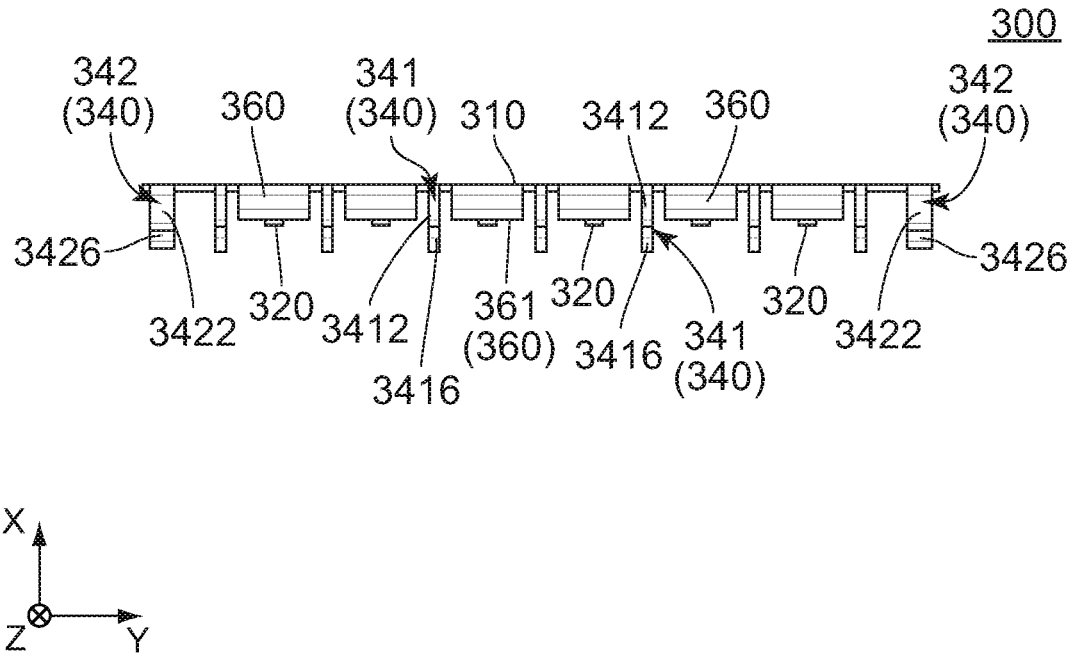
FIG. 27 is a bottom view showing the ground member of FIG. 22.

As shown in FIGS. 23 and 25, the bent portion 360 of the present embodiment extends from the lower end of the main portion 310. More specifically, the bent portion 360 extends inward in the third direction from the lower end of the main portion 310 and is then bent to extend upward. As shown in FIG. 9, an inner end 361 of the bent portion 360 in the third direction is nearer to the connecting object 800 than to the main portion 310 under the attached state. The bent portion 360 is positioned outward of the signal contact portion 840 in the third direction under the attached state. The bent portion 360 covers a part of the signal line 820 under the attached state. The bent portion 360 covers a part of the shield layer 850 under the attached state. An end 362 of the bent portion 360 is positioned above the lower end 852 of the shield layer 850 under the attached state.

If the ground member 300 has no bent portion 360, a part of the signal contact portion 840, which is exposed to the outside of the harness 600, has an increased specific impedance. This causes an impedance mismatch in the transmission line of the connecting object 800. Meanwhile, the ground member 300 of the harness 600 of the present embodiment has the bent portions 360. The bent portion 360 can prevent the part of the signal contact portion 840, which is exposed to the outside of the harness 600, from having an increased specific impedance. Thus, the bent portion 360 can prevent an impedance mismatch in the transmission line of the connecting object 800.

As shown in FIG. 23, each of the held portions 370 of the present embodiment has a flat-plate shape perpendicular to the second direction. Each of the held portions 370 extends inward in the third direction. Each of the held portions 370 is positioned around an upper end of the main portion 310. The held portions 370 are positioned at opposite ends, respectively, of the main portion 310 in the second direction. Each of the held portions 370 extends inward in the third direction from an outer end of the main portion 310 in the second direction. As shown in FIG. 20, the held portions 370 are held by the main portion holding portions 210, respectively, of the holding member 200. Specifically, each of the held portions 370 is press-fit into the main portion holding portion 210 corresponding thereto.

The structure of the ground member 300 is not limited thereto. For example, the ground member 300 can be modified as described below.

Figure 29:
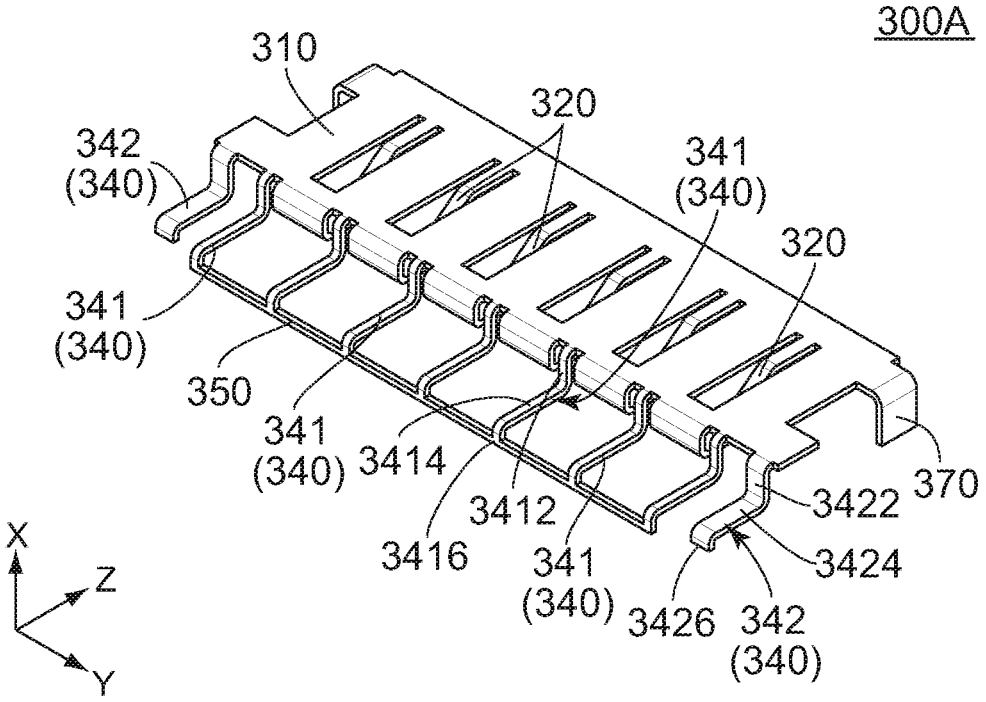
FIG. 29 is a perspective view showing a modification of the ground member of FIG. 22.
Figure 30:
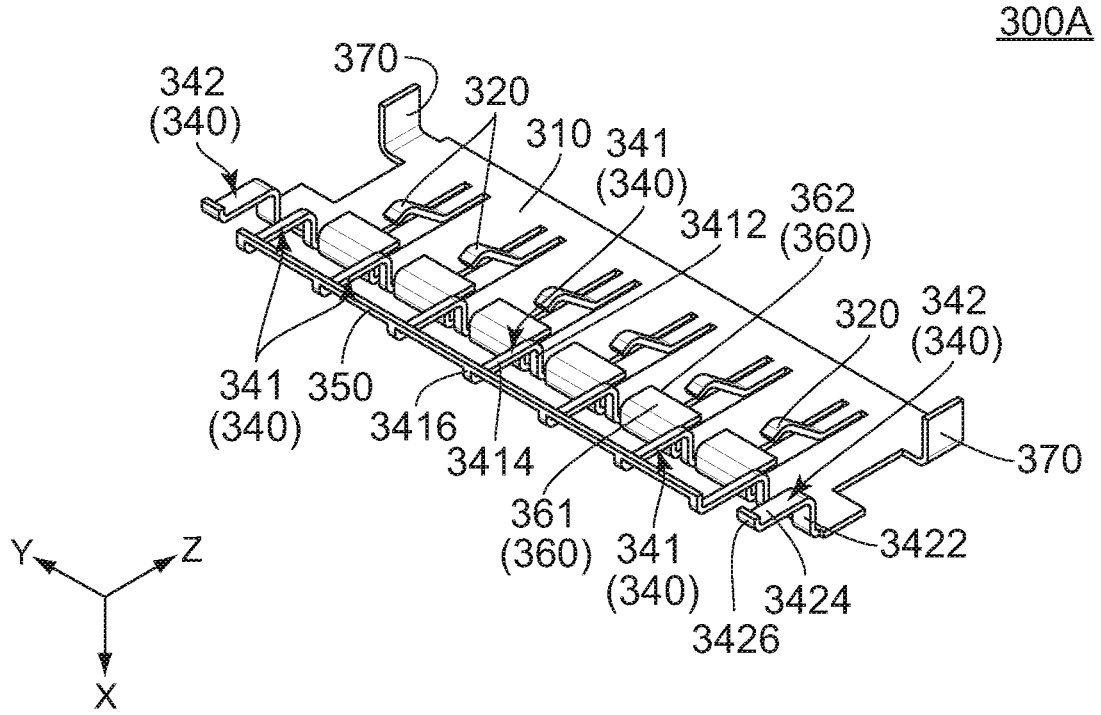
FIG. 30 is another perspective view showing the ground member of FIG. 29.
Figure 31:
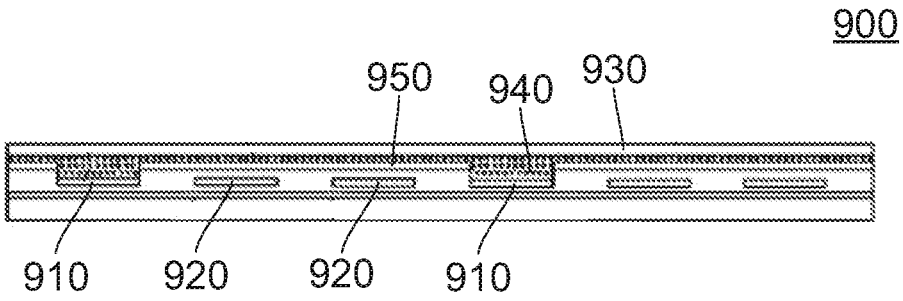
FIG. 31 PRIOR ART
FIG. 31 is a cross-sectional view showing an FFC of Patent Document 1.

As shown in FIG. 29, a ground member 300A according to a modification of the present invention has a coupling portion 350. Components of the ground member 300A other than the coupling portion 350 have structures same as those of the ground member 300 of the aforementioned embodiment. Accordingly, a detailed explanation thereabout is omitted.

As shown in FIG. 29, the coupling portion 350 of the present embodiment couples ends of ground contact portions 340 with each other. More specifically, the coupling portion 350 couples inner ends in the third direction of third portions 3416, 3426 with each other in the second direction. Since the ground member 300A of the present modification has the coupling portion 350, the ground contact portions 340 are further commonly grounded and the resistance to the ground potential is further reduced.

Although the specific explanation about the present invention is made above referring to the embodiments, the present invention is not limited thereto and is susceptible to various modifications and alternative forms.

Although the mating connector 500 of the present embodiment is the straight connector so that the connector 100 is mateable with the mating connector 500 along the first direction, or along the up-down direction perpendicular to the circuit board 700, the present invention is not limited thereto. Specifically, the mating connector 500 may be a right angle connector so that the connector 100 is mateable with the mating connector 500 along a front-rear direction parallel to the circuit board 700. In other words, the first direction may be the front-rear direction.

In the present embodiment, the mating signal terminals 510 and the main mating ground terminals 531 are arranged in the two rows, and the mating signal terminals 510 and the main mating ground terminals 531 of each of the two rows are arranged in the second direction. However, the present invention is not limited thereto. Specifically, the mating signal terminals 510 and the main mating ground terminals 531 may be arranged in one row or arranged in three or more rows.

Although the specific explanation about the present invention is made above referring to the embodiments, the present invention is not limited thereto and is susceptible to various modifications and alternative forms.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A harness comprising a connecting object and a connector, the connecting object having a sheet-like shape, wherein:
- the connecting object has a wiring layer, a shield layer and a first insulator;
- the wiring layer includes at least one signal line;
- the signal line has a signal contact portion;
- the shield layer covers the wiring layer via the first insulator which is positioned between the shield layer and the wiring layer;
- the connector is attached with the connecting object;
- the connector is mateable with a mating connector along a first direction;
- the connector comprises a holding member and a ground member;
- the holding member partially holds the connecting object;
- the ground member is attached with the holding member;
- the ground member has a contact spring and at least two ground contact portions;
- the contact spring is brought into contact with the shield layer;
- the signal contact portion of the at least one signal line is positioned between two of the ground contact portions in a second direction perpendicular to the first direction;
- the mating connector comprises at least one mating signal terminal and at least two mating ground terminals;
- the signal contact portion is brought into contact with the mating signal terminal under a mated state where the connector is mated with the mating connector; and
- the ground contact portions are brought into contact with the mating ground terminals, respectively, under the mated state.

2. The harness as recited in claim 1, wherein:
- the ground member further has a main portion with a flat-plate shape;
- the contact spring extends from the main portion;
- the contact spring is brought into contact with the shield layer at a place which is positioned inward of the main portion in a third direction perpendicular to both the first direction and the second direction; and
- each of the ground contact portions extends in the first direction from the main portion.

3. The harness as recited in claim 1, wherein:
- the ground member has a coupling portion;
- each of the ground contact portions has an end in the first direction; and
- the coupling portion couples the ends of the ground contact portions with each other.

4. The harness as recited in claim 1, wherein:
- the connecting object further has an additional shield layer and a second insulator;
- the additional shield layer covers the wiring layer via the second insulator which is positioned between the additional shield layer and the wiring layer; and
- the wiring layer is positioned between the shield layer and the additional shield layer in a third direction perpendicular to both the first direction and the second direction.

5. The harness as recited in claim 1, wherein:
- the at least one signal line includes two of the signal lines which constitute a differential pair; and
- the at least one mating signal terminal includes two of the mating signal terminals which correspond to the differential pair.

6. The harness as recited in claim 1, wherein:
- the wiring layer has an area which corresponds to the ground contact portion in the second direction; and
- the area of the wiring layer is provided with no conductive member.

7. The harness as recited in claim 1, wherein the connecting object is a Flexible Flat Cable (FFC).

8. A connecting object used for connection to a device, the connecting object having a sheet-like shape, wherein:
- the device has at least two ground pins and at least one signal pin;
- the at least one signal pin is arranged between two of the ground pins in a pitch direction;
- the connecting object has a wiring layer, a shield layer and an insulator;
- the wiring layer is formed with only a signal line which is configured to be connected with the signal pin;
- the wiring layer is formed with no ground line which is configured to be connected with the ground pin; and
- the shield layer covers the wiring layer via the insulator which is positioned between the shield layer and the wiring layer.

9. A connector attachable with a connecting object having a sheet-like shape, wherein:
- the connecting object has a wiring layer, a shield layer and an insulator;
- the wiring layer includes at least one signal line;
- the signal line has a signal contact portion;

the shield layer covers the wiring layer via the insulator which is positioned between the shield layer and the wiring layer;

the connector is mateable with a mating connector along a first direction;

the connector comprises a holding member and a ground member;

the holding member partially holds the connecting object under an attached state which the connector is attached with the connecting object;

the ground member is attached with the holding member;

the ground member has a contact spring and at least two ground contact portions;

the contact spring is brought into contact with the shield layer under the attached state;

under the attached state, the signal contact portion of the at least one signal line is positioned between two of the ground contact portions in a second direction perpendicular to the first direction;

the mating connector comprises at least one mating signal terminal and at least two mating ground terminals;

when the connector in the attached state is mated with the mating connector, the signal contact portion is brought into contact with the mating signal terminal; and when the connector is mated with the mating connector, the ground contact portions are brought into contact with the mating ground terminals, respectively.

10. A connector attachable with a connecting object having a sheet-like shape, wherein:

the connecting object has a wiring layer, a conductive layer and an insulator;

the wiring layer includes at least one trace;

the trace has a first contact portion;

the conductive layer covers the wiring layer via the insulator which is positioned between the conductive layer and the wiring layer;

the connector is mateable with a mating connector along a first direction;

the connector comprises a holding member and a conductive member;

the holding member partially holds the connecting object under an attached state where the connector is attached with the connecting object;

the conductive member is attached with the holding member;

the conductive member has a contact spring and at least two second contact portions;

the contact spring is brought into contact with the conductive layer under the attached state;

under the attached state, the first contact portion of the at least one trace is positioned between two of the second contact portions in a second direction perpendicular to the first direction;

the mating connector comprises at least one mating first terminal and at least two mating second terminals;

when the connector in the attached state is mated with the mating connector, the first contact portion is brought into contact with the mating first terminal; and when the connector is mated with the mating connector, the second contact portions are brought into contact with the mating second terminals, respectively.

* * * * *